US005896154A

United States Patent [19]

Mitani et al.

[11] Patent Number: 5,896,154

[45] Date of Patent: *Apr. 20, 1999

[54] INK JET PRINTER

[75] Inventors: Masao Mitani; Kenji Yamada; Osamu Machida, all of Hitachinaka, Japan

[73] Assignee: Hitachi Koki Co., Ltd., Tokyo, Japan

[ * ] Notice: This patent is subject to a terminal disclaimer.

[21] Appl. No.: 08/439,936

[22] Filed: May 12, 1995

Related U.S. Application Data

[63] Continuation-in-part of application No. 08/228,897, Apr. 18, 1994, Pat. No. 5,666,140.

[30] Foreign Application Priority Data

| | | | |
|---|---|---|---|
| Apr. 16, 1993 | [JP] | Japan | 5-090123 |
| Sep. 17, 1993 | [JP] | Japan | 5-231913 |
| Dec. 17, 1993 | [JP] | Japan | 5-318272 |
| May 13, 1994 | [JP] | Japan | 6-100143 |
| Jun. 20, 1994 | [JP] | Japan | 6-137198 |
| Nov. 14, 1994 | [JP] | Japan | 6-278852 |

[51] Int. Cl.[6] ..... B41J 2/21

[52] U.S. Cl. ..... 347/102; 347/104

[58] Field of Search ..... 347/43, 102, 104; 355/72, 75

[56] References Cited

U.S. PATENT DOCUMENTS

| | | | |
|---|---|---|---|
| 3,811,828 | 5/1974 | Ohta et al. . | |
| 4,335,389 | 6/1982 | Shirato et al. . | |
| 4,831,419 | 5/1989 | Iaia et al. | 355/76 |
| 5,371,531 | 12/1994 | Rezanka et al. | 347/43 |

FOREIGN PATENT DOCUMENTS

| | | | |
|---|---|---|---|
| 489622 | 2/1973 | Japan . | |
| 54-51837 | 4/1979 | Japan . | |
| 55-109672 | 8/1980 | Japan . | |
| 58-188685 | 4/1983 | Japan | 347/102 |
| 62-167056 | 7/1987 | Japan . | |
| 4166966 | 6/1992 | Japan . | |
| 5313528 | 11/1993 | Japan . | |
| 5341672 | 12/1993 | Japan . | |

OTHER PUBLICATIONS

Nikkei Mechanical, Dec. 28, 1992, pp. 58–63.

J. Baker et al.; "Design and Development of a Color Thermal Inkjet Print Cartridge"; Hewlett–Packard Journal, Aug. 1988.

Hall et al., "Inkjet Printer Print Quality Enhancement Techniques" *Hewlett Packard Journal* Feb. 1994, vol. 45, No. 1.

*Primary Examiner*—David M. Gray
*Assistant Examiner*—Michael Dalakis
*Attorney, Agent, or Firm*—Whitman, Curtis & Whitman

[57] ABSTRACT

In an ink jet printer, a belt-type preheating unit 2 pressingly heats a recording sheet 6 while transporting the recording sheet in a transport direction B on a belt. A suction transport device 3 is positioned downstream of the belt-type preheating unit 2 in the transport direction B. The suction transport means transports, on its transport belt, the recording sheet 6 heated by the belt-type preheating unit 2 in the transport direction B while fixing the recording sheet onto the transport belt by a vacuum suction. An ink jet print head, positioned confronting the suction transport device 3, records images by ejecting water-based ink onto the recording sheet which is being transported by the suction transport device.

32 Claims, 12 Drawing Sheets

INK JET PRINTER

CROSS-REFERENCE TO RELATED APPLICATION

This application is a continuation-in-part application of Ser. No. 08/228,897 filed Apr. 18, 1994 now U.S. Pat. No. 5,666,140.

BACKGROUND OF THE INVENTION

1. Field of the Invention

The present invention relates to an ink jet printer.

2. Description of the Related Art

For safety reasons, the ink used in ink jet printer is usually a water-based ink. To prevent clogging of nozzles, water-based ink that evaporates slowly must be used. However, such ink also dries slowly after printing so that printed sheets are difficult to handle. Because water-based ink runs easily, there has been a problem of different color inks running together and mixing during color printing. Also, precision of printing drops when recording sheets wrinkle, expand, or stretch. Attempts have been made to reduce severity of these problems by improving the recording sheets. However, these methods require production of special sheets that are expensive. Recording devices for rapidly drying the ink on the printed sheets are described on page 35 in the February 1994 issue of Hewlett-Packard Journal (not prior art). Actual methods described include heating printed sheets directly after printing to dry the printed sheets. The printed sheets are heated by streams of hot air, by radiant heat, or by heated platen rollers.

However, all these methods require detection of the temperature of the printed sheet and control of energization of the heat source. Safety measures such as for preventing overheating and generation of smoke and fire are necessary. Normally heating efficiency is low. However, power consumption is not always low. Generally a long waiting period is required for the heat source to heat up after the power is turned on until when printing is possible.

SUMMARY OF THE INVENTION

It is therefore an objective of the present invention to provide a method of drying ink on printed sheets and a high-speed ink jet printer wherein printing can be started quickly after turning on the power, wherein power consumption is low, wherein detection of the temperature of printed sheets and control of energization of the heat source are unnecessary, wherein measures for preventing generation of smoke and fire are unnecessary, and wherein safety measures can be reduced. It is a further objective of the present invention to provide an ink jet printer wherein feathering of printed characters is greatly reduced, wherein, in the case of color printing, running and mixing of different colored inks is prevented, wherein drops in printing precision caused by wrinkling, expanding, or stretching of recording sheets is prevented, and wherein print quality equal to print quality attained using high-quality specially produced recording sheets can be obtained using normal recording sheets.

In order to attain the above objects and other objects, the present invention provides an ink jet printer for printing ink onto a recording sheet, the ink jet printer comprising: belt-type preheating means for pressingly heating a recording sheet while transporting the recording sheet in a transport direction; suction transport means, positioned downstream of the belt-type preheating means in the transport direction, the suction transport means including a transport belt, the suction transport means transporting, on the transport belt, the recording sheet heated by the belt-type preheating means in the transport direction while fixing the recording sheet onto the transport belt by a vacuum suction; and ink ejection means, positioned confronting the suction transport means, for recording images by ejecting water-based ink onto a recording sheet which is being transported by the suction transport means. The belt-type preheating means preferably includes: a preheater for heating the recording sheet, the preheater having a heat source for generating heat, a belt mounted on the heat source in contact therewith, the belt transporting the recording sheet on one surface of the belt while contacting the heat source at the other surface, and a drive source for driving the belt; and a pressure roller positioned in contact with the belt for rotating synchronously with the belt driven by the drive source, the recording sheet being transported between the belt and the pressure roller while being pressed against the pressure roller, the belt transmitting heat from the heat source to the recording sheet. The suction transport means preferably includes: a transport belt support for supporting the transport belt, the transport belt support having an outer wall, on which the transport belt slides to move in the transport direction, and an inner wall for defining a vacuum duct, the vacuum duct being communicated with an air suction pump, a plurality of openings being formed through the transport belt support from the inner wall to the outer wall, the suction being performed through the plurality of openings; and a drive source for driving the transport belt in the transport direction.

According to another aspect, the present invention provides a method of recording on a recording medium using an ink jet print head, the method comprising the steps of: serially preheating the recording medium directly before recording; transporting the recording medium, after preheating, by a transport belt while fixed to the transport belt by vacuum suction; and causing an ink jet print head to jet ink droplets onto the recording medium while being transported by the transport belt.

BRIEF DESCRIPTION OF THE DRAWINGS

The above and other objects, features and advantages of the invention will become more apparent from reading the following description of the preferred embodiment taken in connection with the accompanying drawings in which:

FIG. 11 (*b*) is a top view showing another pattern formed by ink droplets ejected using the circuitry shown in FIG. 10;

DETAILED DESCRIPTION OF THE PREFERRED EMBODIMENT

Figure 1:
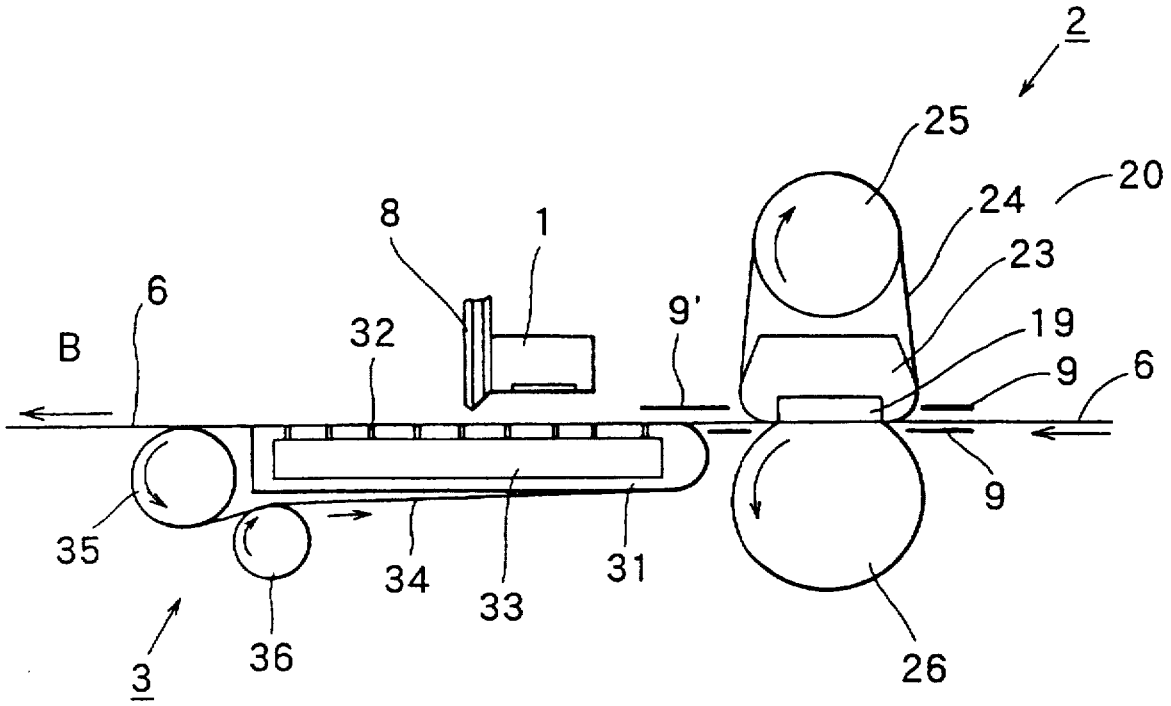
FIG. 1 is a schematic cross-sectional view of an ink jet printer of a preferred embodiment of the present invention.

An ink jet printer according to a preferred embodiment of the present invention will be described while referring to the accompanying drawings wherein like parts and components are designated by the same reference numerals to avoid duplicating description.

An ink jet printer of a preferred embodiment will be described with reference to FIG. 1. As shown in FIG. 1, the ink jet printer of the present embodiment mainly includes a preheating unit 2, an ink jet print head 1, and a vacuum suction transport device 3. The preheating unit 2 and the vacuum suction transport device 3 are arranged to form a transport path along which they transport an object to be printed (referred to as recording sheet 6 hereinafter). The print head 1 is positioned confronting the vacuum suction transport device 3 so as to face an upper surface of the recording sheet 6 which is being transported on the vacuum suction transport device 3.

A recording sheet 6 inserted into the printer through an inlet (not shown) is guided by a transport guide 9 to be introduced to the preheating unit 2. The preheating unit 2 heats and dries the recording sheet 6, while transporting the recording sheet in a transport direction (indicated by an arrow B) along the transport path. As shown in the figure, the preheating unit 2 is constructed from a combination of a belt-type preheater 20 and a pressure roller 26. The belt-type preheater 20 is for serially heating the recording sheet 6 while pressing the recording sheet 6 against the pressure roller 26. The heated recording sheet 6 is guided by another transport guide 9' to the vacuum suction transport device 3. The vacuum suction transport device 3 transports the recording sheet 6 beneath the print head 1, where images are recorded on the recording sheet 6. The vacuum suction transport device 3 transports the recording sheet 6 by a transport belt 34 while vacuum suctioning the recording sheet 6 to fix it onto the transport belt. The vacuum suction transport device 3 also vaporizes moisture from the recording sheet 6, and reduces the temperature of the recording sheet 6. The recording sheet 6 is then discharged out of the printer through an outlet (not shown) positioned downstream of the transport path in the transport direction B.

As described above, according to the present invention, the preheating unit 2 is constructed from a combination of the pressure roller 26 and the belt-type preheater 20. The belt-type preheater 20 includes a positive temperature coefficient (PTC) thermistor heater 19 with an auto-temperature control function and a predetermined Curie temperature of 150° C., for example. A belt 24 is mounted over the PTC heater 19 and a drive roller 25. The belt 24 is driven by the drive roller 25 to transport the recording sheet 6 on its one surface while its another surface being in contact with the PTC heater 19. The pressure roller 26 is rotatably supported, at a position confronting the PTC heater 19. The pressure roller 26 is positioned in contact with the belt 24 for rotating synchronously with the belt driven by the drive roller. The recording sheet 6 is therefore transported between the belt 24 and the pressure roller 26 while being pressed against the pressure roller 26. Heat generated at the PTC heater 19 is transmitted through the belt 24 to the recording sheet 6 which is being transported between the endless belt 24 and the pressure roller 26. When the Curie temperature for the PTC heater 19 is 150° C., for example, the recording sheet 6 is heated to a fixed temperature in a range of between 80 and 90° C. Because the PTC thermistor heater 19 can control its temperature not to exceed its Curie temperature, the sheet 6 is ensurely heated to the fixed temperature. High heat efficiency is obtained because the sheet 6 is pressingly transported by the pressure roller 26. Even envelopes and the like can be transported and heated without being wrinkled.

The vacuum suction transport device 3 includes a belt support 31. An uneven surface, with variation of about ±100 μm between high and low areas, may be provided to the surface of the belt support 31. An endless belt 34 is rotatably supported on the belt support 31 so that a portion of the endless belt 34 is aligned with the path of the sheet 6 as the sheet 6 exits from the preheating unit 2 in the transport direction B. A drive motor 35 is provided for rotating the endless belt 34 at a speed synchronized with speed of the sheet 6 as transported by the preheating unit 2. A plurality of holes (not shown) about 0.5 mm in diameter, for example, are formed through the entire surface of the endless belt 34 at a pitch of 3 to 4 mm, for example. A plurality of suction holes 32 are formed through the belt support 31 at almost the same pitch. A suction duct 33 is formed inside the belt support 31 for fluidly connecting the suction holes 32 with an air suction pump (not shown).

The ink jet print head 1 is supported to confront a sheet 6 transported on the endless belt 34. A suction nozzle 8 for producing a partial vacuum near the surface of a printed sheet 6 may be provided at the side of the head 1 opposite the vacuum suction transport device 3.

A sheet 6 heated to 80 to 90° C., for example, by the preheating unit 2 and discharged therefrom is taken up by the rotating endless belt 34. The sheet 6 is fixed to the endless belt 34 by the suction of the suction device 3 as transmitted via the suction duct 33, the suction holes 32, and the holes formed in the endless belt 34. The uneven surface of the belt support 31 can prevent the endless belt 34 from being overly strongly fixed to the belt support 31 by the suction from the suction duct 33. The preheated print sheet 6 is printed on by the ink jet print head 1 while being transported as fixed to endless belt 34. The heat of the sheet 6 dries ink that impinges on the sheet 6 in about 0.3 to 0.4 seconds, in this example, after printing. Evaporate from the drying ink can be sucked up and exhausted via the suction nozzle 8 so it does not adhere to the head 1. Therefore, despite a print speed of 150 mm/sec, an image printed on the sheet 6 can be handled as soon as it is discharged from the vacuum suction transport device 3.

The above-described structure of the present invention can ensure extremely fast and safe ink jet printing operation. Contrary to the above-described heating device which heats the sheet before the sheet is printed, conventional dryers for drying a printed sheet after it is printed require inclusion of a non-contact rapid heating device such as an infrared heater which is larger and not as safe.

Any type of ink jet print head can be applied to the ink jet printer of the present invention, including static electric type heads, piezoelectric type heads, and thermal type heads, with the same good results. It is noted, however, that conventional thermal type heads have a printing speed of about 0.5 pages per minute. On the other hand, a multi-color or full-color ink jet print head of a large-scale, high-density thermal type of the present invention (which will be described later with reference to FIGS. 8 through 16) can attain a print speed of 100 pages per minute. Therefore, drying time restricts the print speed of the ink jet printer. Conventional methods to dry wet ink on a recording sheet include either heating or drying the recording sheet in a non-contacting manner or heating the underside of the recording sheet using a heat transmission device. Thermal efficiency in both of these methods is poor. In contrast, the preheating unit 2 according to the present invention heats the surface of the recording sheet, on which images will be recorded, by contact pressure before recording, thereby achieving optimum thermal efficiency. Preheating in this manner not only dries printed image within a short period of time but also evaporates the moisture that has been absorbed by recording sheets during their storage. Recording sheets transported underneath the print head are heated to a high temperature and dried to a low moisture level to almost fixed conditions. That is, recording sheets when transported past the print head are at ideal conditions for printing regardless of their storage conditions, which can attain high quality image printing operation.

Also, the recording sheets transported under the print head are fixed by vacuum suction to the transport belt. When the recording sheet is made from a material that air can pass through, such as paper, the suction from the suction transport belt pulls ink impinged on the recording sheet in the thickness direction of the recording sheet. This can utilize high-speed drying capability of the heated and dried recording sheet in the thickness direction so that droplets of different colored inks serially impinged on the recording sheet spread and mix only slightly.

Accordingly, especially employing the high printing speed thermal head (to be described later with reference to FIGS. 8–16) in the present ink jet printer can attain high printing speed while attaining high quality printing.

Transporting the recording sheet as fixed to the transport belt by vacuum suction reduces to a minimal level deformation of the recording sheet caused by stretching during recording processes. Therefore, poor positioning of impinged ink droplets can be reduced to a minimum during full-color printing so that high-quality full-color images can be obtained.

Almost the same good effects can be obtained when recording images on plastic sheets, such as those used in overhead projectors, through which air can not pass. This is because plastic sheets retain a great deal more heat than do paper sheets and so ink impinged thereon dries much faster. Two-layered recording sheets such as envelopes can be rapidly printed on, because the belt-type preheater heats and dries the recording sheets without wrinkling them.

First through third concrete examples of the ink jet printer of the present invention will be described below with reference to FIGS. 2 through 7. These examples are directed to a full-color thermal ink jet printer.

According to these examples, the print head 1 is a full-color line head. The line head 1 is fixedly mounted in the ink jet printer to extend perpendicularly to the transport path. The print head 1 includes four parallel rows of ink ejection nozzles facing the recording sheet 6. Each row extends for a length equivalent to the entire width of a recording sheet 6. The four rows are arranged along the transport direction B. One of the nozzle rows is for ejecting black water-based ink and the other three rows are for ejecting colored water-based inks such as yellow, cyan, and magenta inks.

Preferably, the full-color line head 1 may be a large-scale, high-density thermal jet print head, the structure of which will be described later in greater detail with reference to FIGS. 8 through 16. The line head 1 includes four rows of nozzles which are separated from each other by about 1.5 mm, for example. The nozzles of each row are aligned at a density of, for example, 400 dpi in lines (dots per inch) in the direction perpendicular to the transport direction B the recording sheet 6 is transported.

As shown in FIGS. 2 through 7, the ink jet printer of each of example not only includes the preheating unit 2, the vacuum suction transport device 3, and the print head 1, but also includes: an orifice cap 4 for capping the nozzles of the print head 1; and an orifice surface cleaning unit 5 for cleaning a surface of the orifice cap 4. These elements are described in detail in co-pending U.S. Pat. No. 5,670,996 filed Mar. 31, 1995 by Masao Mitani, the disclosure of which is hereby incorporated by reference. Because these elements are not directly related to the present invention, their detailed explanation will be omitted here.

The first example will be described below with reference to FIGS. 2 through 5.

Figure 2:
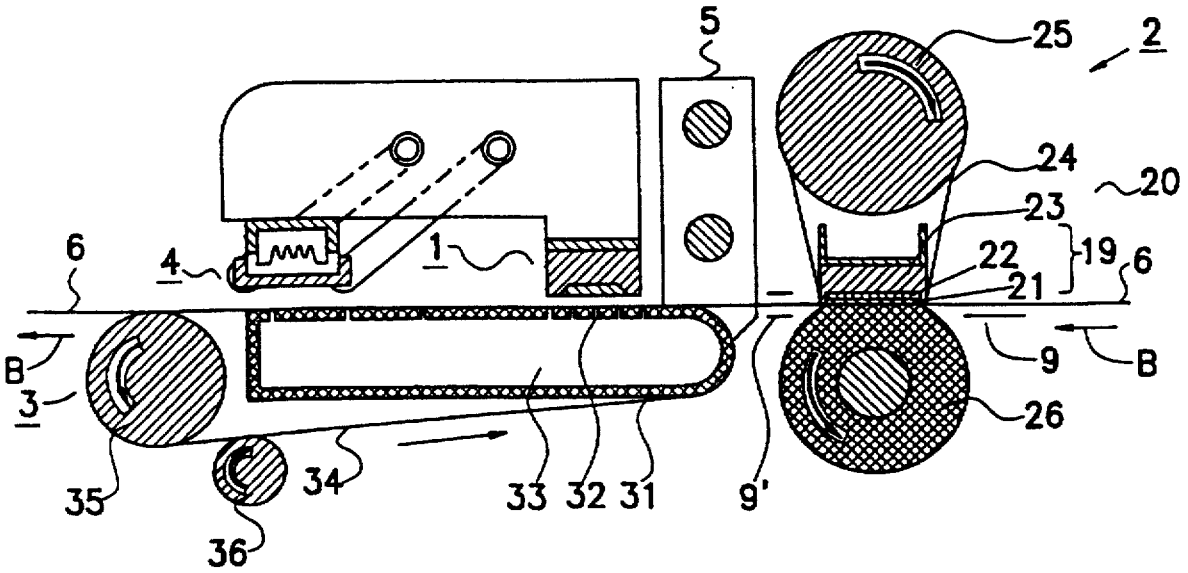
FIG. 2 is a schematic cross-sectional view of a full-color thermal ink jet printer of a first concrete example of the present embodiment.

First, the belt-type preheater 20 constituting the preheating unit 2 will be described below with reference to FIG. 2.

One type of a belt-type heater has been described in U.S. Pat. No. 3,811,828 as a fixing device for a laser printer. The heater is for lowering power consumption of the printer while maintaining quick start capability of the printer. The heater includes an infrared lamp or thermal resistor element as a heat source, which requires an accurate temperature control. An endless belt employed in this heater is a two-layer structure formed from a polyimide resin film, that is thermal-resistant and that retains its stiffness even at high temperatures, covered with non-stick polytetrafuoroethylene (PTFE) for preventing toner off-set.

Contrarily, in the belt-type preheater 20 of the present example, the PTC heater 19 is constructed from a plurality of thin positive temperature coefficient thermistor heater chips (which will be referred to as "PTC heater chips"

hereinafter) 22 and a single heat-transmission plate 21. The PTC heater 19 is buried in a holder 23 in a position that the heat-transmission plate 21 is exposed to confront the pressure roller 26. An endless belt 24 is mounted around the holder 23 and the drive roller 25. As the drive roller 25 rotates as indicated by an arrow in the figure, the endless belt 24 moves in the transport direction B where the endless belt 24 is sandwiched between the heat-transmission plate 21 and the pressure roller 26.

About ten PTC heater chips 22 are buried in a recess formed in the holder 23. The PTC heater chips 22 are arranged in a row extending perpendicularly to the transport direction B. The single heat-transmission plate 21 is laminated over all the PTC heater chips 22. A single electrode plate (not shown) is provided over the surfaces of the PTC heater chips 22 confronting the heat-transmission plate 21. The electrode plate entirely covers the surfaces of the PTC heater chips 22. Two other electrode strips (also not shown) are provided on the other surfaces of the PTC heater chips 22. An electric power source (not shown) is connected between the electrode strips so that electric currents flow inside of the PTC heater chips 22 between the electrode strips and the electrode plate to generate heat therein. The PTC heater chip 22 serves as a self-controlled heat source. When the temperature of the PTC heater chip 22 rises to reach its own Curie temperature, resistivity of the PTC heater chip 22 rapidly increases to restrain heat generation.

A PTC heater chip has a low heat transmission rate, and therefore easily develops internal temperature distributions, which cause its electrical resistance to increase. This phenomenon is known as the pinch effect. The decrease in current flow caused by the pinch effect restricts the amount of heat the PTC heater chip can produce so that the PTC heater chip cannot rise to the desired temperature. According to the present invention, to give the PTC heater chip sufficient heating capacity, the PTC heater chips are formed 0.9 mm thick and the electrode plate is provided entirely over one side of each chip that is contacted with the heat-transmission plate 21.

The heat-transmission plate 21 is made from zirconia-toughened alumina ceramics. The heat-transmission plate 21 has good heat transmission characteristics for transmitting heat generated in the PTC heater chips 22, especially at the sides of the PTC heater chips 22 entirely covered with the electrode plate, toward the endless belt 24. The heat-transmission plate 21 is also for providing a smooth surface and good lubricity in regards to the endless belt 24.

It is difficult to produce a single long PTC heater chip that is sufficiently smooth. Therefore, in the present example, the smooth heat-transmission plate 21 is disposed between the array of ten aligned PTC heater chips 22 and the endless belt 24. Because the surface of the heat-transmission plate 21 is smooth, the endless belt 24 will not catch against it and crinkle up. The heat-transmission plate 21 has small abrasion and friction coefficients, a high thermal transmission rate, is inexpensive, and has good electric insulation properties. The zirconia-toughened alumina ceramics (for example, "Hallocks Z" produced by Hitachi Chemical Co., Ltd.) is an optimal material for the heat-transmission plate 21.

According to the present invention, the endless belt 24 is formed from a single layer of polyimide resin. One surface of the endless belt 24 is contacted with the heat-transmission plate 21, while the other surface being for transporting the recording sheet 6. The endless belt 24 transmits heat from the one surface contacted with the heat-transmission plate 21 to the other surface contacted with the recording sheet 6. The endless belt 24 driven by the drive roller 25 slides against the heat-transmission plate 21 while transporting the recording sheet 6.

The pressure roller 26 is provided in confrontation with the heat-transmission plate 21 via the endless belt 24 so that the transport path is located between the belt-type preheater 20 and the pressure roller 26. The pressure roller 26 rotates in a direction indicated by an arrow in the figure as the drive roller 25 rotates as shown in the figure. The belt-type preheater 20 and the pressure roller 26 cooperate to transport the recording sheet 6 in the transport direction B in pressing contact with the recording sheet 6. The pressure roller 26 is made of foam silicon rubber with hardness of five or less on the Japan Industrial Standard A (JIS-A) scale, for the following reasons. When printing both sides of the recording sheet 6, the recording sheet 6 should be inserted into the ink jet printer so that the pressure roller 26 will be in pressing contact with the side already printed. It is therefore desirable that the pressure roller 26 be formed from silicon rubber, which has excellent non-stick properties. Assuming that the printed side of the recording sheet 6 has been printed using toner (toner with a low softening point of 110 to 120 degrees C. is common) applied using a laser beam printer, silicon rubber has superior non-stick properties in regards to toner that does PTFE. Silicon rubber also has sufficient non-stick properties in regards to surfaces printed with liquid using ink jet printers. It is desirable that the combination of the heat-transmission plate 21 and the pressure roller 26 can efficiently transmit heat to the recording sheet 6 while sandwiching it therebetween at its nip portion. It is also desirable that the endless belt 24 and the heat-transmission plate 21 produce only a small friction force and a small amount of abrasion when sliding against each other. To fill these requirements, it is necessary to decrease the pressure of the pressure roller 26 while increasing the width of the nip portion to increase the time of thermal contact. For this reason, the pressure roller should be made of foam silicon rubber with hardness of five or less on the Japan Industrial Standard A scale, so that the width of the nip can easily be increased to about 8 mm.

Experiments were performed for the preheating unit 2 constructed as described above.

In the experiments, a 100 [V] alternating current (AC) power source was connected to the electrode strips provided on the PTC heater chips 22 to heat the PTC heater chips 22. As the drive roller 25 rotated, the endless belt 24 was moved and the pressure roller 26 was rotated accordingly. The endless belt 24 used during these experiments was 25 micrometers thick, the heat-transmission plate 21 was 0.3 mm thick, the PTC heater chips 22 were 8 mm wide, the pressure roller 26 was made of foam silicon rubber to produce an 8 mm nip with the endless belt 24, the PTC heater chips 22 with Curie temperature of 170 degrees C. were selected, and the transport speed of the recording sheet was 50 mm/s. The temperature at the surface of the heat-transmission plate 21 was measured. The temperature at the surface of the recording sheet 6 was also measured upon its exit from the preheating unit 2. The results of these experiments were plotted in the graph shown in FIG. 3.

Figure 3:
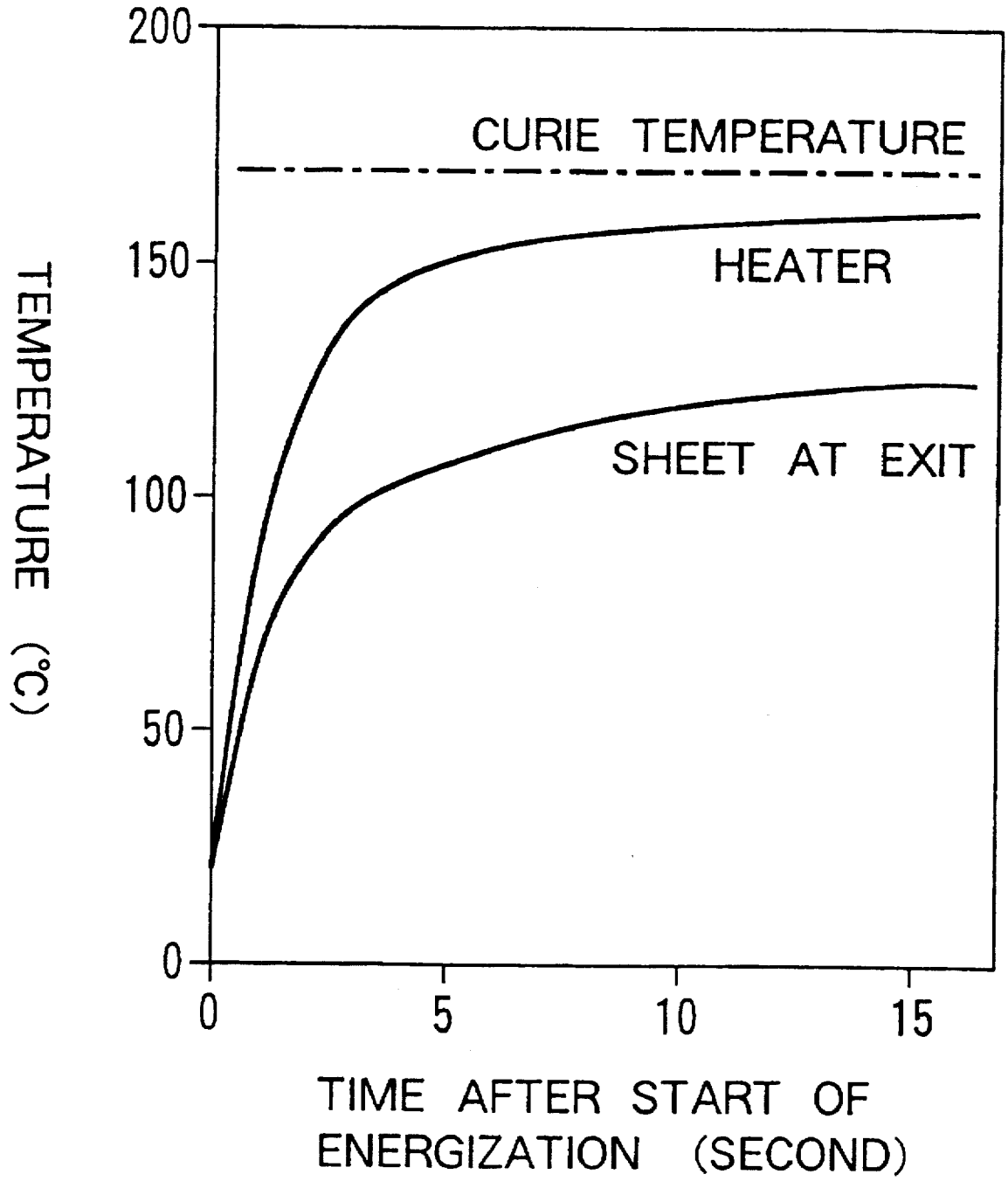
FIG. 3 is a graph of experiment results that show time-dependent changes of the temperature at the surface of the heat-transmission plate 21 and of the temperature at the surface of the recording sheet 6 upon its exit from the preheating unit 2.

As can be seen in FIG. 3, the temperature of the PTC heater chips 22 rose to near its Curie temperature about 5 to 10 seconds after energization of the PTC heater chips 22 began. That is, a recording sheet 6 introduced into the preheating unit 2 five seconds after start of energization (when the recording sheet 6 is an A4 size sheet fed lengthwise at a speed of eight to nine pages per minute) will be heated to 100 to 110 degrees C. and its moisture will rapidly evaporate. When the recording sheet 6 reaches a region beneath the full-color line head 1, it will be almost completely dry and have a temperature of 90 to 100 degrees C.

It is apparent therefore that if the preheating unit 2 is to be combined with a high-speed print head 1 capable of printing 20 to 30 sheets per minute, the PTC heater chips 22 with a higher Curie temperature should be selected. It is noted that PTC heater chips 22 with Curie temperature of 240 degree C. or less are readily available.

The advantages of using PTC heater chips 22 are that they require no temperature detection or energization control, as follows. Because the room temperature recording sheet 6 becomes a heat sink for the PTC heater chips 22, PTC heater chips 22 in the region of the passing recording sheet 6 are energized to return their temperature to the desired temperature. Even when the small recording sheet 6, such as a postcard or other sheet, that is narrower than the length of the PTC heater chip array is to be printed on, only those chips actually confronting the recording sheet are energized. Accordingly, the temperature over the entire length region of the PTC heater chip array can be continuously maintained at a uniform temperature, with variations being within a range of ±5%. It is noted that other types of heaters that do not have this function, such as infrared lamps or thermal resistor elements, are energized equally at all areas, whether cooled by the passing recording sheet 6 or not. As a result, an extremely high temperature will possibly develop at portions of the heaters not confronting the narrow recording sheet 6 so that the polyimide belt may be damaged. To prevent such damage, safety measures, such as temperature dependent termination of printing processes, must be implemented.

Under the same conditions as those in the above-described experiments, other experiments were performed. In the present experiments, the drive roller 25 and the pressure roller 26 were continuously rotated for 200 hours, while the PTC heater chips 22 being continuously energized. The rotational speed of the drive roller 25 was set so that the moving speed of the endless belt 24 was fixed to 50 mm/sec. The 200 hours of operation transported 100,000 pages of A4sized sheets in their longitudinal directions, which was equivalent to running 36 kms of sheets. During this operation, the endless belt 24 and the heat-transmission plate 21 slided against each other with the relative sliding speed of 50 mm/sec.

Figure 4:
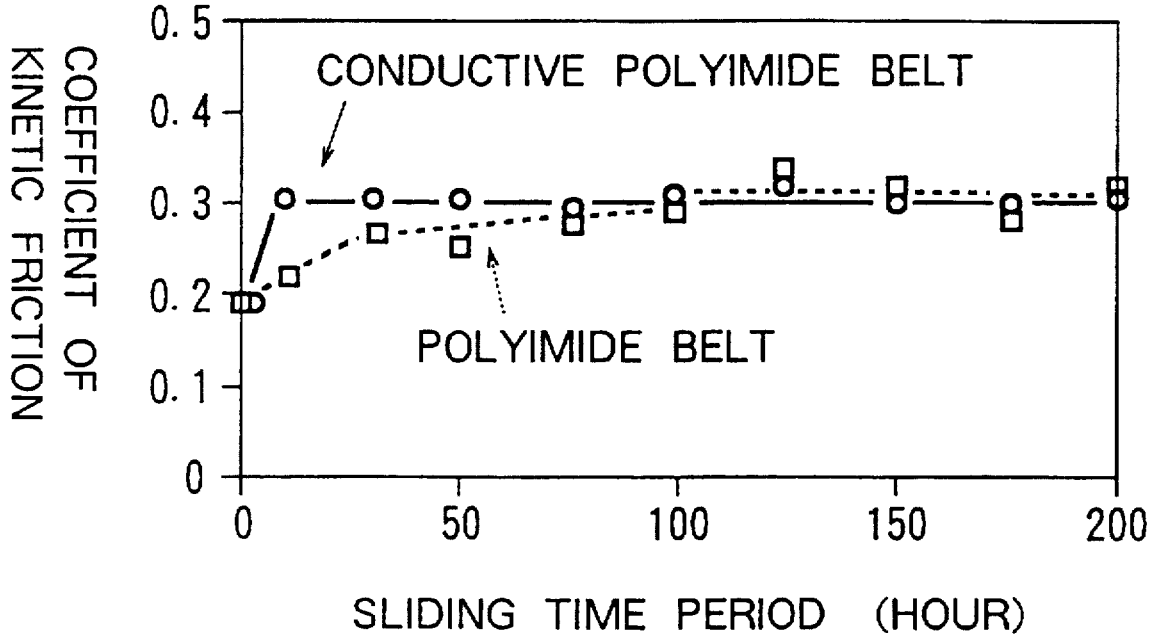
FIG. 4 is a graph of experiment results that show time-dependent change in coefficient of kinetic friction between the heat-transmission plate 21 and the endless belt 24 where the heat-transmission plate 21 was made of zirconia-toughened alumina ceramics while the endless belt 24 being a polyimide belt made from a single layer of polyimide resin and a conductive type polyimide belt made of a single layer of polyimide resin in which carbon particles were dispersed.

The present experiments measured time-dependent change in coefficient of kinetic friction between the heat-transmission plate 21 and the endless belt 24. The experiments were conducted where the heat-transmission plate 21 was made of zirconia-toughened alumina ceramics and the endless belt 24 was the polyimide belt made from a single layer of polyimide resin. The present experiment were also conducted where the endless belt 24 was replaced with a conductive type polyimide belt made of a single layer of polyimide resin in which carbon particles were dispersed. In both experiments, any lubricant were not provided between the heat-transmission plate 21 and the endless belt 24. The results of these experiments are shown in FIG. 4. It is apparent that an extremely small friction coefficient was maintained both in the cases where the endless belt 24 was the polyimide belt and was the conductive type polyimide belt.

During these experiments, the amount of abrasion were also measured, at the surfaces of the endless belt 24 and the heat-transmission plate 21. The amount of abrasion for both the heat-transmission plate 21 and the endless belt 24 was one micrometer or less. It can be concluded therefore that a 25 micrometer thick endless belt 24 could transport about one million pages. Some printers need the capacity to transport several million pages. However, the thicker the endless belt 24, the smaller the thermal transmission efficiency. The endless belt 24 is therefore desirable to have thickness of within 50 micrometers.

The vacuum suction transport device 3 will be described below in greater detail.

The vacuum suction transport device 3 is positioned downstream of the preheating unit 2 in the transport direction B. The recording sheet 6 heated by the preheating unit 2 is guided to the vacuum suction transport device 3 via the guide 9'.

The vacuum suction transport device 3 includes the vacuum duct 33 surrounded by the belt support 31 and communicated with the air suction pump (not shown). An upper flat portion of the belt support 31 is provided with a plurality of openings 32 communicated with the vacuum duct 33. The transport belt 34 is mounted over the belt support 31 and a drive roller 35. As the drive roller 35 rotates in a direction indicated by an arrow in the figure, the part of the transport belt 34 slides over the upper flat part of the belt support 31 to transport the recording sheet 6 in the transport direction B. The speed, at which the transport belt 34 moves, is adjusted equal to or slightly slower than that of the endless belt 24 of the preheating unit 2. A tension roller 36 is provided for supplying appropriate tension to the transport belt 34.

According to the present example, the openings 32 are provided highly densely through the belt support 31 at an area directly under the print head 1. Or otherwise, the openings 32 may be in the form of a plurality of adsorption grooves and may be formed at positions corresponding to the plurality of nozzle rows provided on the print head 1. For example, if four nozzles of four colors of ink are provided on the print head 1, four absorption grooves may be formed in confrontation with the four nozzles, respectively. Each absorption grove may have about 1 mm wide, for example.

According to this example, the density at which the openings are formed at a region far from and downstream of the print head 1 in regards to the transport direction B is smaller than the density at which the openings are formed at a region confronting the print head 1. In other words, fewer openings 32 need be opened in the transport belt support 31 far from and downstream of the print head 1. This is because the openings 32 in this area need only provide suction sufficient for softly or gently fixing the recording sheet 6 to the porous transport belt 34. Also, fewer openings will greatly reduce the amount of vacuum suction force required from the suction duct 33. This also greatly contributes to reducing rotation drive power and amount of abrasion to the porous transport belt 34 when it slides against the belt support 31.

The transport belt 34 is formed with a number of pores or small openings. The porous transport belt 34 is preferably made from glass cloth coated with polyimide or teflon (registered trademark). The glass cloth must be porous such as tangle weave or net-type sheets of glass cloth.

With this structure of the vacuum suction transport device 3, the recording sheet 6 is absorbed by the air suction produced through the openings 32 and the pores in the transport belt 34 from the vacuum duct 33. The entire surface of the recording sheet 6 is uniformly suctioned in the area directly beneath the print head 1. This suction both fixes the heated recording sheet 6 during transportation onto the transport belt 34. Especially when the recording sheet is made from a material that air can pass through, such as paper, the suction also suctions the ink in the thickness direction of the recording sheet 6 (downward), thereby completely preventing ink runs, mixing, and smudges over the entire surface of the heated recording sheet 6. It also greatly contributes to rapidly drying the ink on the recording sheet 6.

Figure 5A:
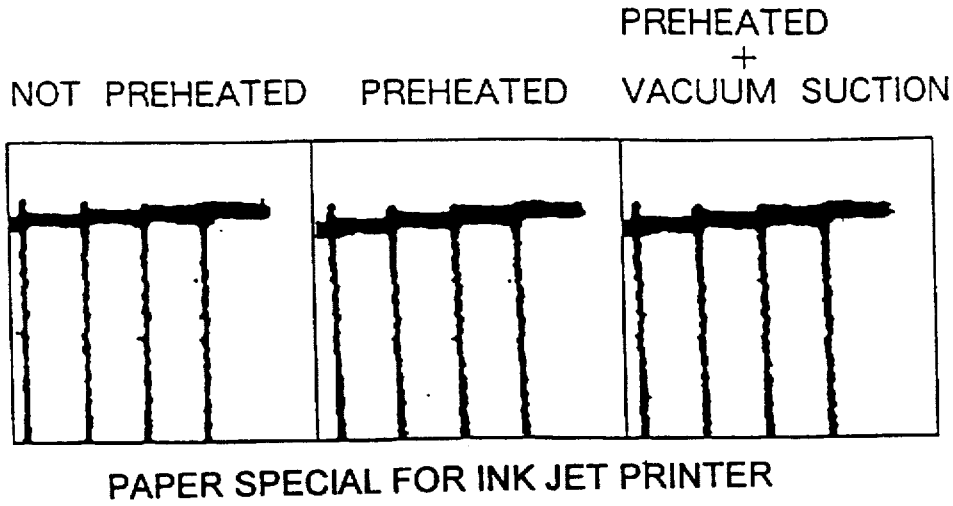
FIGS. 5A–C illustrate magnifications of images printed on several types of papers under several conditions, in which: printing was performed where the papers were at room temperature; printing was performed after when the papers were preheated to about 60 degrees C.; and the papers were preheated to about 60 degrees C. before being printed while suctioned.
Figure 5B:
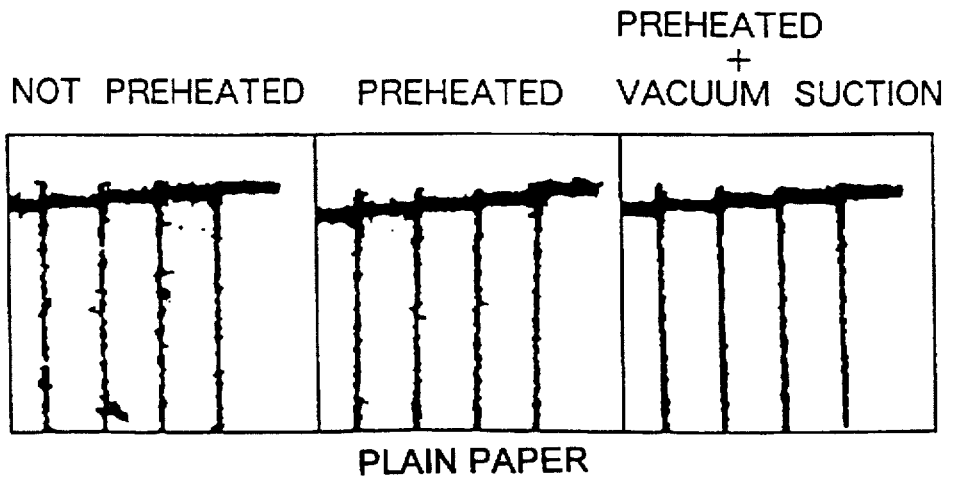
Figure 5C:
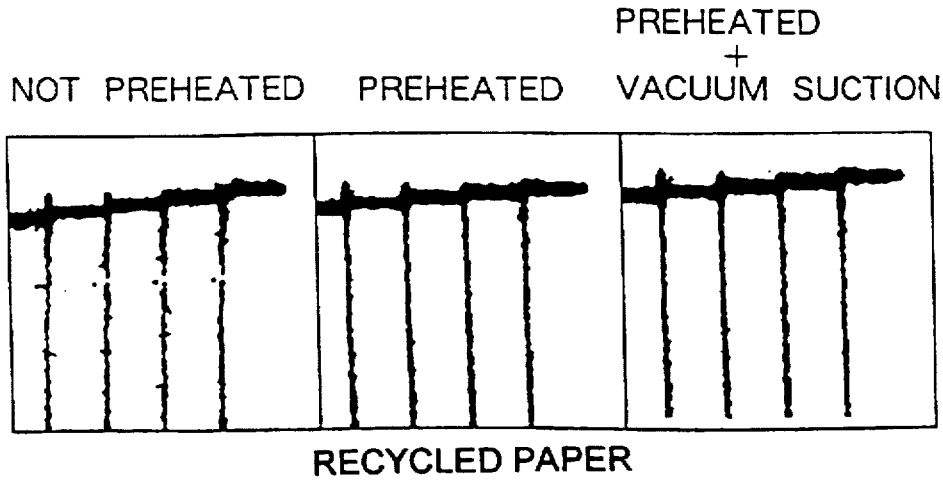

Though the already-described experiments confirmed that the structure of the ink jet printer of the present invention enables to print 30 pages per minute of high-quality full color images, further experiments were performed to determine the effect on feathering during monochrome printing. FIG. 5A shows magnifications of images printed under different conditions on special non-smudging paper developed for ink jet printers. FIG. 5B shows magnifications of images printed under different conditions on plain paper for laser printers. FIG. 5C shows magnifications of images printed under different conditions on recycled paper. In the experiments, images were printed on room temperature sheets; on sheets only preheated to about 60 degrees C.; and on sheets both preheated to about 60 degrees C. and suctioned during printing.

As can be seen, preheating has a great effect on print quality. Because only small amounts of ink are impinged to the sheet during monochrome printing, preheating the sheet only to 60 degrees C. was sufficient to produce the results shown. It is noted, however, that about ten times as much ink is ejected and impinged to sheets during full-color printing. Therefore, ink needs to be dried by preheating recording sheet to 100 degrees C. or more and also suctioning in order to maintain quality. The same quality images can be obtained using recording sheets of plain paper or recycled paper as when using recording sheets of specially produced expensive paper made to meet special specifications.

It is noted that no satellites (subdroblets) were observed in sheets printed during these experiments, because the print head used in these experiments was a satellite free ink jet print head described in co-pending U.S. patent application Ser. No. 08/387,579, the disclosure of which is hereby incorporated by reference. This print head eliminated ghosts and reduced the burden of drying excess ink. The suction vacuum transport is effective for super fine printing, especially between 600 and 800 dpi.

The present example is directed to a printer employing a line head that extends the entire width of a recording sheet 6. However, the present example could be combined with a smaller scanning-type color head with equally good results.

Vacuum suction transport does not contribute to quality of images printed on overhead projections sheets, because air can not pass through the overhead projection sheets. However, the rapid drying resulted from the vacuum suction transport can still prevent mixing of different colored inks and ink running on the overheat projection sheets.

As described above, according to the present example, because an endless belt made from heat-resistance hard polyimide resin is used in the belt-type preheater, the polyimide resin layer should be made between 20 to 50 micrometers thick in order to effectively transfer the heat from the heat source to the recording sheet and considering the effects of abrasion produced when the endless belt slides against the zirconia-toughened alumina ceramics heat plate, which has excellent heat transmission, stiffness, slickness, and electrical insulation properties.

Because PTC heater chips are used for the heat source for the preheater 20, recording sheets can be heated to a desired temperature without performing any temperature control. The temperature of the heat source can normally be set to a fixed value in correspondence with a printing speed set to the print head. That is, the preheater 20 should be made from only one type of PTC heater chips having a fixed Curie temperature so that the set temperature need not be changed.

It is noted that print speed attainable by the print head changes depending on whether the print head is a line head or a scanning head. Therefore, the PTC heater chips should be chosen by their Curie temperatures, in correspondence with the type of the print head. It is further noted that the PTC heater chips with Curie point of 230 degrees C. or less (which translates to about 180 degrees C. or less at the surface of recording sheets) should be used in order to prevent overheating the recording sheets when trouble occurs during their transport. Accordingly, PTC heater chips with Curie point in the range of 120 degrees C. and 230 degrees C. should preferably be used.

According to the present example, a larger vacuum suction force is applied by the vacuum suction transport device to the printing region than to a region far from and downstream of the printing region. This ensures suction force large enough at the first stage of introducing the recording sheet into the transport device. Because the transport belt is formed from an endless belt made from a finely porous film or a mesh sheet, the transport can apply a uniform vacuum suction across the entire surface of the recording sheet at the printing region, which contributes to obtaining printed images with high quality.

Thus, according to the present example, a body to be recording on is heated and dried by a belt-type preheater at the region directly before the recording means and then transported fixed in placed by vacuum suction while being recorded on by the recording means. Images with equal quality can be recorded on recording sheets made from plain paper, recycled paper, or paper specially made for ink jet printers. Also, images dry rapidly, thereby facilitating handling of recording sheets even when full-color images are recorded on the recording sheets.

The belt-type preheater that uses PTC heater chips requires no complicated or expensive control. Also, consecutive recording of any sized recording sheet can be safely performed without worry of damaging components from overheating. Suction produced by using a porous endless belt for the suction transport belt yields high-speed drying and high print quality across the entire surface of the recording sheet. Feathering can be greatly reduced by printing on high-temperature and highly dried recording sheets. Images can be recorded on plain paper and recycled paper with the same quality as expensive paper specially produced for use with ink jet printers.

Figure 6:
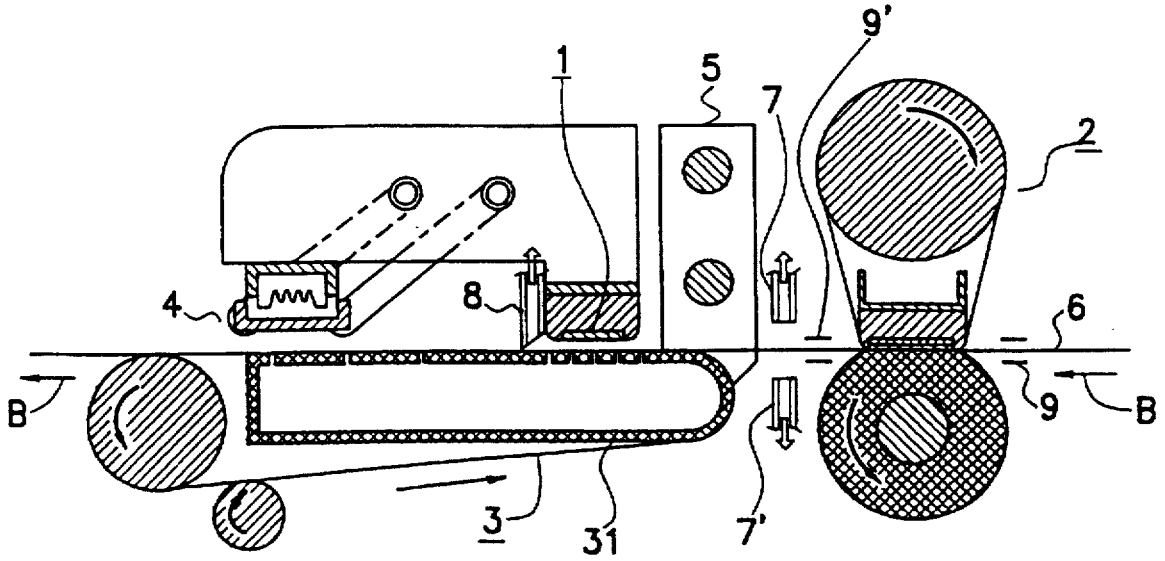
FIG. 6 is a schematic cross-sectional view of a full-color thermal ink jet printer of a second example of the present embodiment.

A second concrete example of the ink jet printer will be described below with reference to FIG. 6.

According to the structure of the ink jet printer of the present invention, moisture is produced during the recording sheet 6 is printed with water-based ink while being suctioned. In the case where the recording sheet 6 is made from a moisture-absorbing material, such as a paper, moisture is produced also during the recording sheet 6 is preheated by the preheating unit 2. It is therefore desirable to prevent the water vapor from clinging to proximal components. The second example is provided for appropriately exhausting the water vapor in a manner that does not adversely effect print quality.

A printer of the second example is the same as that of the first example, except that vapor exhaust slits are provided in the second example. According to the present example, as shown in FIG. 6, a pair of first exhaust slits 7 and 7' are provided at a region between the preheating unit 2 and the vacuum suction transport device 3 along the transport path so as to exhaust air from that region. The first exhaust slits 7 and 7' are positioned in confrontation with each other so that the transport path is located therebetween. The first exhaust slits 7 and 7' serve to suction moisture released from both sides of the recording sheet 6 preheated by the preheating unit 2. The first exhaust slits 7 and 7' are built with a length equal to the width of the recording sheet 6 and positioned so the length spans the width of the recording sheet 6. The guides 9' provided to this section insures that the recording sheet 6 is smoothly transported to the vacuum suction transport device 3 while suctioned by the first exhaust slits 7 and 7'.

According to the present example, a second exhaust slit 8 is provided at a region close to and downstream of the print head 1 in the transport direction B for exhausting air from that region. The second exhaust slit 8 confronts the upper surface of the belt support 31. The second exhaust slit 8 therefore serves to suck out moisture that is released from the water-based ink impinging on the recording sheet 6 and that fills the narrow gap between the print head 1 and the recording sheet 6. The second exhaust slit 8 is built with a length equal to the width of the recording sheet 6 and positioned so the length spans the width of the recording sheet 6 as are the first exhaust slits 7 and 7'.

Similarly to the first example, according to the structure of the ink jet printer of the present example, the recording sheet 6 is preheated by the preheating unit 2 to 100 degrees C. or more, and then transported to the vacuum suction transport device 3. At this time the recording sheet 6 is heated to 100 degrees C. or more. When the recording sheet 6 is made from a moisture-absorbing material, moisture is rapidly released from the recording sheet 6 directly after it passes out of the preheating unit 2. The moisture is suctioned into the first exhaust slits 7 and 7' from both surfaces of the recording medium 6.

The recording sheet 6, heated to 100 degrees C. or more and almost completely dry, is transported underneath the print head 1 as fixed to the transport belt 34 of the vacuum suction transport device 3 by vacuum suction. The print head 1 prints images on the recording medium 6 by serially ejecting water-based ink. The moisture in the water-based ink (which is 90 to 95% water) rapidly evaporates upon impinging on the recording sheet 6, resulting in the narrow gap (of about one to two millimeters) between the print head 1 and the recording sheet 6 filling with water vapor. The temperature of the produced water vapor is slightly higher than the ambient temperature. The water vapor is sucked out of the gap by the second exhaust slit 8 and exhausted so that the water vapor is not condensed on the surface of the print head.

Experiments were conducted for the ink jet printer of the present example. A full-color line head 1 used in these tests had the structure of FIGS. 12–15 (which will be described later). The line head had the width of a 210 mm A4 sheet and included four parallel rows of ink ejection nozzles. Each row contained 3,360 nozzles per row aligned at 400 dpi. Rows were separated by about 1.6 mm. The individual nozzles were capable of firing at a frequency of between 0 to 15 KHZ. In other words, the full-color line head was capable of printing at a speed of 100 pages or more of A4 size paper per minute.

Several print tests were performed for printing A4 size papers with the ink jet printer of the present example.

First, print tests were performed changing the print speed within the range of 5 and 20 pages per minute. Evaluations of these tests revealed no difference in print quality when print speed was changed within this range. Therefore, the first exhaust slits 7 and 7' and the second exhaust slit 8 dried the released moisture rapidly enough for printing within this printing speed range.

Further printing tests were performed by changing conditions of the suction by the first exhaust slits 7 and 7' and the second exhaust slit 8.

Printing tests were performed without activating both the first exhaust slits 7 and 7' and the second exhaust slit 8. A great deal of moisture condensed in the proximity of the full-color line head 1 after printing was performed for only a few minutes, even at the slow print speed of five pages per minute. Some droplets of condensed water were observed having dropped on the surface of the recording medium 6.

Next, printing was performed while exhausting air through the second exhaust slit 8 only. Although condensation greatly dropped, droplets of condensed moisture could sometimes be still observed on the recording sheet 6, depending on the moisture content of the recording sheet 6 and the printing speed.

In contrast, no condensation or adverse effects to proximal components were observed when suction exhaust was appropriately performed through both the first exhaust slits 7 and 7' and the second exhaust slit 8.

It is noted, however, that some ink droplets impinged at imprecise locations on the recording medium, resulting in poor print quality, when suction through the second exhaust slit 8 was too strong or when exhaust was irregular.

The additional tests were then performed. First, the speed that suction from the second exhaust slit 8 caused air to flow from the gap between the print head 1 and the recording sheet 6 was measured. Print tests were then performed, while changing the suction from the second exhaust slit 8 and changing the air flow speed. According to the print tests, poor print quality was observed when flow in the gap between the full-color line head 1 and the recording sheet 6 was 2 m/s or more. This poor print quality was probably caused by turbulence that destabilized the trajectory of the ink droplets.

Then, print tests were performed by intentionally disturbing the flow speed distribution locally in the gap between the print head 1 and the recording sheet 6. The test results show that even when flow in the gap was 2 m/s or less, turbulence produced in the gap resulted in the poor print quality. In normal printing condition, the turbulence can be possibly produced at either edge of the full-color line head 1 or can be produced by any obstruction located in the gap.

The test results further show that fairly acceptable print quality was obtained when variation in air flow speed were ±5%/cm or less locally and ±20% or less along the entire length (i.e., in the direction nozzles are aligned) of the head.

These conditions are easily met by providing a flow regulator upstream from and on both sides of the full-color line head 1. No condensation was observed at a flow speed of 1.0 to 1.5 m/s even when printing at a speed of 20 pages per minute.

When a scanning-type head is used instead of the line head 1, the second exhaust slit 8 not only must exhaust air from between the head 1 and the recording sheet 6 but must also exhaust air from freshly printed surfaces of the recording sheet 6 exposed after the print head passes by. However, the conditions for condensation do not change substantially from when the line head 1 is used. It was confirmed through printing tests using a scanning-type head that the proximity of the printed recording sheet 6 must be exhausted in virtually the same manner to prevent condensation.

As described above, in the ink jet printer of the second example, moisture that has been absorbed by the recording sheet during its storage evaporates from the surface of the recording sheet directly after preheating. This moisture vapor is suction vented through exhaust slits positioned at front and rear surfaces of the recording sheet. Therefore, the ambient humidity will not increase. When water-based ink is printed at high speeds onto a high-temperature and highly dry recording sheet, a great deal of moisture vapor is generated. By sucking this moisture vapor into the other ventilation slit positioned downstream of the print head, increases in ambient humidity can be suppressed. However, it is imperative that the ventilation suction is controlled not to disturb the trajectory of ejected ink droplets.

Contrary to papers, plastic sheets for overhead projectors have low moisture content. Little moisture is produced during those sheets are preheated. Accordingly, ventilation is basically unnecessary after preheating those recording sheets with low moisture content. However, it is still necessary to ventilate moisture vapor that is released from water-based ink impinged on the recording sheet and coming upstream of the print head.

Figure 7:
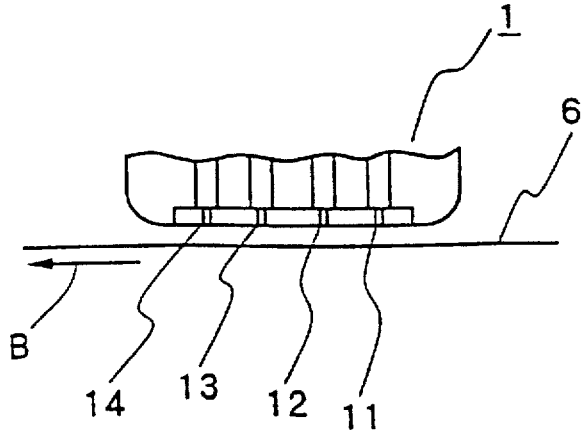
FIG. 7 is a schematic cross-sectional magnified view of a print head in a full-color thermal ink jet printer of a third example of the present embodiment.

A third example will be described below with reference to FIG. 7.

The structure of an ink jet printer of the third example is the same as those of the first and second examples, except for the arrangement in the ink nozzles in the print head 1.

Generally, both monochrome and full-color ink jet printers are used to record characters comprised mainly of black straight lines. In fact, full-color printing accounts for only about 20% of all printing. Even when several pages are printed in full color, there are often times when nozzles for ejecting yellow, cyan, or magenta ink do not operate. Because the nozzles are not capped during printing, the ink in inactive nozzles will dry and become more viscous. This can result in clogged nozzles. According to the present invention, the recording sheet 6 is preheated before passing next to the print head 1. The radiant heat from the thus preheated recording sheet 6 will possibly increase the rate at which ink in inactive nozzles dries. The third example is therefore provided for preventing viscosity of ink in inactive nozzles from increasing to prevent clogging of nozzles, thereby resulting in printing clear full color images.

Similarly as in the first and second examples, the print head 1 is formed with four rows of nozzles: a black-ink row 11, and three color-ink rows 12, 13, and 14. Each row extends perpendicularly to the transport direction B. According to the present example, as shown in FIG. 7, the four rows are arranged along the transport direction B so that the black-ink row 11 is positioned most upstream side in the transport direction B, i.e., at a position nearest to the first exhaust slits 7 and 7'.

In the ink jet printer according to the present example, recording medium to be printed on is preheated so that moisture of water based ink impinged thereon rapidly evaporates. This results in the narrow approximately 1 mm gap between the recording medium and the print head being brought to a moisture saturated condition. The fixed print head (line head) is oriented so that the row of black ink nozzles is upstream of the nozzle rows for other colors. With this orientation, even when most printing is in black ink only, the other rows of nozzles are also surrounded by moisture saturated air, so the ink in color nozzles will not dry.

Print tests were conducted for evaluating the quality of the resultant print images and the frequency of nozzle clogging. To provide a subject of comparison, in one set of experiments the nozzles in the lead row were filled with black ink (present example) and in another set the nozzles in the tail row (i.e., the row nearest to the second exhaust slit 8) were filled with black ink. In other words, the print head of the present example with the lead row filled with black ink was used in one set of experiments, while a head of a comparative example with the tail row filled with black was used in the other set of experiments. The full-color line head used for the print head 1 for these tests was the same as that used in the tests in the second example and therefore had the structure shown in FIGS. 12 through 15. Because the frequency of ink ejections can be varied from 0 to 15 KHz, the head 1 was capable of full-color printing at a speed of 100 pages or more of A4 size recording sheets per minute. In these tests, the head 1 was operated to print 20 pages per minute. Sheets of normal printing paper for laser beam printers were used as the recording sheets 6 in these experiments.

First, the preheating unit 2 was operated so that full-color printing was performed on recording sheets heated to 120 degrees C. Print quality and frequency of clogs were evaluated. Then, character printing was performed with black ink only, and frequency of clogs were evaluated. The frequency of clogs was evaluated using general relative values.

The results of the experiments are shown in Table 1 below.

TABLE 1

| | Full-color Printing | | Frequency of clogging in color |
|---|---|---|---|
| | Print Clarity | Clogging Frequency | nozzles during black printing |
| Lead Row Black | Good | 1.0 | 1.5 |
| Tail Row Black | Fair | 1.0 | 6.0 |

As apparent from the test results for full-color printing, no difference could be seen in the frequency of clogging between the two sets of experiments. As to the print quality, images printed in black ink bled a relatively high amount when printing was performed with the tail row of nozzles filled with black ink. Print quality was somewhat inferior. This is because dots first printed on the hot and dry sheet showed the least bleeding and dots printed next were more likely to show a great deal of bleeding.

When character printing was performed with black ink only, the frequency, at which clogging of color nozzles was observed when the head of the comparative example was used, is three to four times higher than that when the present head was used. The rating system used for clogging in these evaluations was roughly based on when clogging could be observed in the process of printing ten sheets. For example, a value of one was assigned when clogging was observed during printing of the tenth sheet, but a value of six was assigned when clogging was observed during printing of the first or second sheet. Observed trends were more striking when printing was performed with a pigment type ink because pigments type inks are difficult to redissolve (redisperse) once their viscosity has increased. To prevent clogging, pigment type inks require more care than die type inks.

The above-described experiments show that using the print head with black ink ejected from the lead row of nozzles produced the superior results. However, it can be supposed that even when the print head with the lead row of black ink is used, nozzle clogging will still occur during normal printing operations. For example, nozzle clogging will possibly occur after long waiting time periods provided during successive printing operations. Nozzle clogging will occur also after almost all the nozzles are not fired to print an almost entirely white image.

It is therefore preferable to dummy eject all of the nozzles at the bottom of each printed sheet (that is, about 0.5 to 1.0 mm, for example, from the bottom edge of the sheet) to improve reliability of the print head 1. The line produced on the recording sheet from a single dummy ejection of all nozzles will be at most 0.2 mm high, which is within acceptable limits. This dummy ejection prevents nozzle clogs produced from overly viscous ink.

Though the above description is directed to a line head, the present example can be applied to a scanning print head. The present example can be applied to the scanning print heads both of unidirectional printing type and of reciprocal printing type. According to the scanning print head of unidirectional printing type, ink droplets are ejected only while the print head is scanned in one direction. In this type of print head, out of four rows of nozzles, the lead row of nozzles should be filled with black ink. According to the print head of reciprocal printing type, ink droplets are ejected twice while the print head is scanned reciprocally. In this type of print head, an additional fifth row of nozzles filled with black should be positioned at the opposite side as the first black ink row, so that both sides of the print head had nozzles for ejecting black ink.

Evaluation experiments were performed using the full-color scanning type print head 1. The scanning head was positioned at the same place as the line head. Print speed was reduced to four pages per minute. Experiments were performed for both the unidirectional printing type head and the reciprocal printing type head. The unidirectional type used in these experiments had four rows of 128 nozzles, with the lead row of nozzles filled with black ink. The reciprocal type used in these experiments had five rows of 128 nozzles, with the lead and tail rows of nozzles filled with black ink.

When all the nozzles were dummy ejected at a rate of about one dummy ejection for every two or three sheets of printing, no nozzle clogging was observed in color nozzles even during printing only with black ink. This result was observed in both cases that the unidirectional type head was used and the reciprocal type head was used. This is because the scanning movement of the heads brings the colored ink nozzles into the moisture-saturated atmosphere produced from the black ink.

In the full-color printer, the amount of moisture vapor produced per unit time decreases proportionally to the amount the printing speed decreases. Additionally, the scanning head cartridge diffuses the ambient air so that the first and second exhaust slits are not necessary. This will allow reductions in the size and cost of the printer.

As described above, according to the present example, all nozzles are surrounded by a moisture-saturated atmosphere. Therefore, ink dries more slowly and clogging of nozzles is reduced.

When the print head is a line head, after each page of printing is completed, all nozzles, including the black ink nozzles, may preferably be dummy ejected at least once to refresh the ink in the nozzles. In other words, dummy ejections onto the bottom portion of the recording sheet are performed periodically to discharge overly viscous ink. This prevents the nozzles from clogging. Accordingly, the reliability of the printer is increased without decreasing the printing speed.

Also when the print head is a scanning type head, nozzles of the lead row are filled black ink. The scanning motion brings the other colored rows into an atmosphere saturated with moisture. Especially good effects can be realized in a reciprocally scanning head with five rows of nozzles when both edge rows are for ejecting black ink. All nozzles are dummy ejection away from the edge of the recording medium after a predetermined number of scans are performed. Nozzles can be prevented from clogging by refreshing the ink in this way.

In order to ensure high reliability of the head, the dummy ejections should be performed regardless of the printing mode.

Following are description of an example of a thermal ink jet print head 1 especially suited for the above-described ink jet printer of the present invention. This ink jet print head of a large-scale, high-density thermal type can attain a high print speed, for example, a print speed of 100 pages per minute or more. Because the preheating unit 2 and the vacuum suction transport device 3 can dry printed ink images rapidly, the combination of this ink jet print head 1 and those components 2 and 3 enables an ink jet printing of a considerably high printing speed.

An example of the ink jet print head 1 will be described while referring to FIGS. 8 through 16.

First, a basic structure of the ink jet print head 1 will be described with reference to FIGS. 8 through 11.

Figure 8:
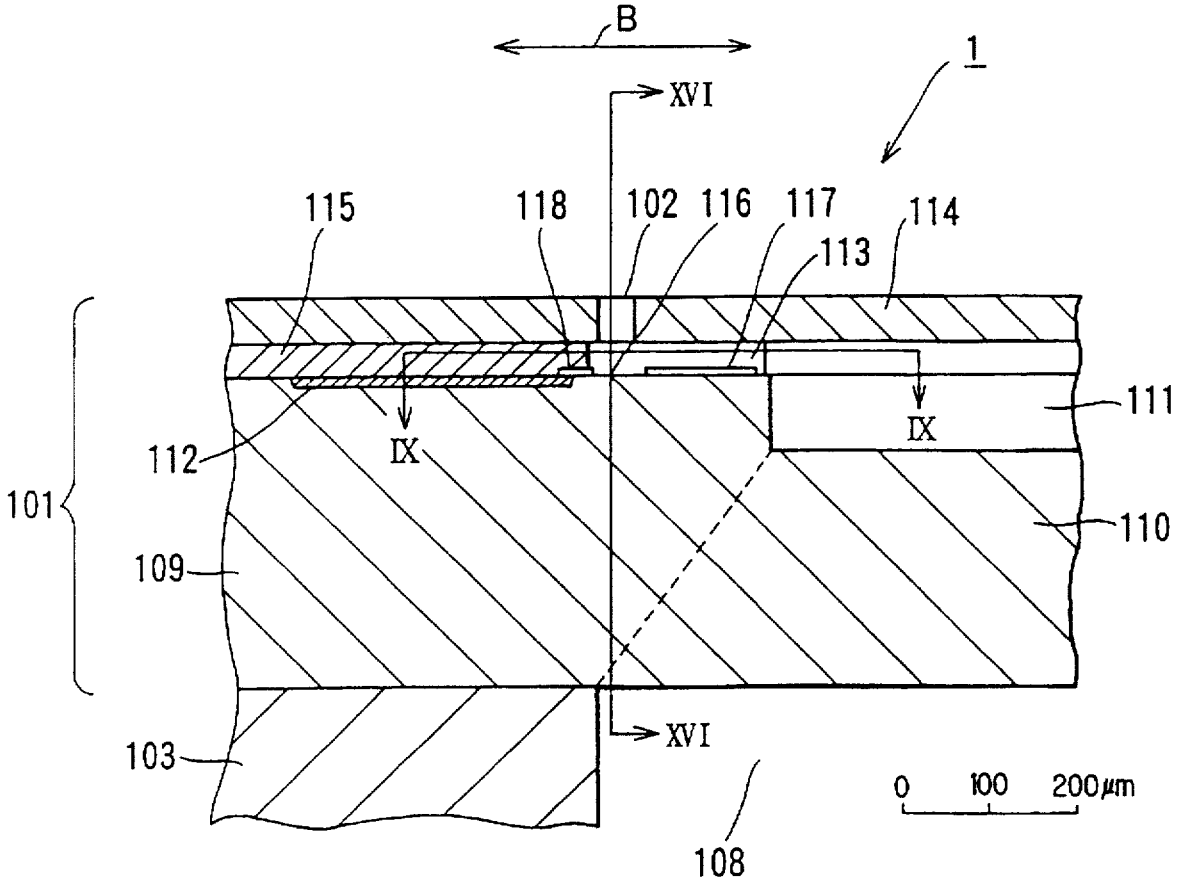
FIG. 8 is a cross-sectional view showing a basic structure of one example of a print head suitably employed in the ink jet printer according to the present invention.
Figure 9:
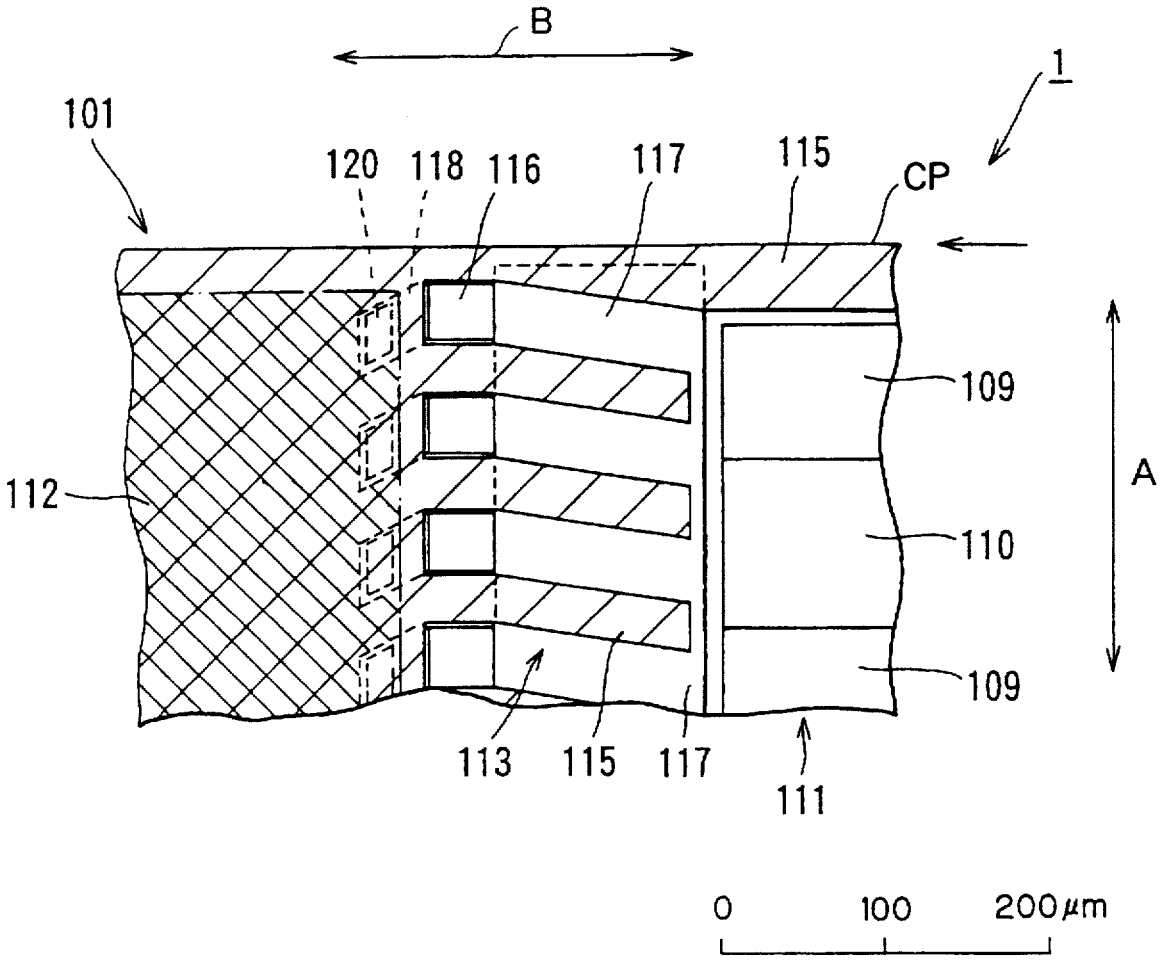
FIG. 9 is a sectional plan view taken along a line IX—IX in FIG. 8.

As shown in FIGS. 8 and 9, the ink jet print head 1 of the present example is constructed from a mounting frame 103 and a monolithic driving section 101 mounted thereon. The monolithic driving section 101 includes a silicon substrate or wafer 109 having a top side and an under side, the under side being attached to the mounting frame 103. The silicon substrate 109 is formed with a common ink channel 111, at its top side. The common ink channel 111 extends in a direction A indicated in FIG. 9 (which will be referred to as a "main scanning direction," hereinafter). The ink jet print head 1 is oriented in the ink jet printer of FIG. 1 so that the main scanning direction A extends perpendicularly to the transport direction B. The silicon substrate 109 is further formed with a plurality of connection channels 110 extending between a bottom surface of the common ink channel 111 and the under side of the silicon substrate 109. The connection channels 110 are formed in the substrate 109 intermittently along the main scanning direction A, as shown in FIG. 9. The mounting frame 103 is formed with a single ink supply channel 108 extending in the main scanning direction A and connected to the connection channels 110. The mounting frame 103 is provided with an ink supply port 106 (not shown) fluidly connected to the ink supply channel 108 for supplying ink thereto.

A partition member 115 is provided on the top side of the silicon substrate 109 so as to define a plurality of ink chambers 113 which are all connected to the common ink channel 111. The ink chambers 113 are aligned in the main scanning direction A.

A thermal resistor 116 and a pair of conductors 117 and 118 connected to the thermal resistor 116 are provided in each of the ink chambers 113. The thermal resistor 116 and the conductors 117 and 118 are provided on the top side of the silicon substrate 109.

A cover member 114 provided over the partition member 115 is formed with a plurality of nozzles 102, each of which is connected to a corresponding one of the plurality of ink chambers 113. The ink jet print head 1 is located in the ink jet printer of FIG. 1 so that the nozzles 102 confront the vacuum suction transport device 3.

Each ink chamber 113 provided with the thermal resistor 116 and the conductors 117 and 118 and the nozzle 102 connected to the ink chamber 113 construct an ink droplet generator for ejecting an ink droplet from the nozzle 102. Accordingly, the print head 1 of this example has a plurality of ink droplet generators arranged in the main scanning direction A perpendicular to the transport direction B of FIG. 1.

With the above structure, ink supply pathway for supplying ink toward each of the ink droplet generator is constructed by the ink supply channel 108, the plural connection holes 110, and the common ink channel 111 which are fluidly connected with one another.

A single drive large scale integrated circuit (LSI circuit) 112 is formed on the top side of the silicon substrate 109, through a semiconductor process. The LSI circuit 112 is for driving the thermal resistors 116 in all the ink chambers 113. The thermal resistors 116 are connected to the drive LSI circuit 112 in such a manner that the corresponding individual conductors 118 are connected via through-hole connectors 120 to collector electrodes (not shown) provided in the drive LSI circuit 112.

The thermal resistor 116 and the conductors 117 and 118 are a Cr—Si—SiO alloy thin-film resistor and nickel thin-film conductors, respectively. Details of the Cr—Si—SiO alloy thin-film resistor and nickel thin-film conductors are described in a co-pending U.S. patent application Ser. No. 08/068,348, the disclosure of which is hereby incorporated by reference. For example, the thermal resistor 116 and the conductor lines 117 and 118 are formed to a thickness of 700Å and 1 μm, respectively. The resistance of the thin-film resistor 116 is about 1,500Ω. An approximately 1,500 Å thick $Ta_2O_5$ anti-etching layer (not shown) and an approximately 2 μm thick $SiO_2$ heat insulation layer (not shown) are provided under the thin-film resistor 116 and the conductors 117 and 118 on the top side of the silicon substrate 109.

Because the Cr—Si—SiO alloy resistor 116 and the nickel conductors 117 and 118 are not covered by any protection layers and therefore directly heat ink filling in the ink chamber 113, energy required to eject an ink droplet is reduced to about 1 μJ/droplet, that is, about 1/30th the energy required in conventional thermal resistors with protection layers. Co-pending U.S. patent application Ser. No. 068,348 describes tests which determined the life of this protection-layerless thermal resistor is one billion pulses or more regardless of whether the ink ejected is water based or oil based. This reduction in required energy allows positioning the thermal resistors adjacent to and on the same silicon substrate 109 as the drive LSI circuit 112 for driving the thermal resistors.

Co-pending U.S. patent application Ser. No. 08/068,348 further describes that the protection-layerless thermal resistor used in the print head, i.e. formed from the Cr—Si—SiO alloy thin film resistor 116 and nickel conductors 117 and 118, efficiently heats ink in the ink chamber when applied with an extremely short, i.e., 1 μs or less, pulse of voltage. Accordingly, to eject an ink droplet, the drive LSI circuit 112 applies a short pulse, i.e., 1 μs or less, of voltage to the Cr—Si—Si alloy thermal resistor 116 according to a print signal. The thermal pulse generated by the thermal resistor 116 ejects an ink droplet from the nozzle 102. The ejected ink droplet impinges on a sheet 6 supported on the transport belt 34 by a distance of between 1 to 2 mm, for example, from the nozzle 102, thereby forming a dot on the sheet 6.

The following text is a concrete example of a method for forming the print head 1 shown in FIG. 8. First, the common ink channel 111 is photoetched into one side of a silicon wafer to a depth of approximately 150 μm using either a good inorganic resist (such as $SiO_2$ or $Si_3N_4$) or an organic resist (such as a polyimide). The connection ink holes 110 are then photoetched into the reverse side of the silicon wafer to form the side of the silicon substrate 109 which will confront the head mounting frame 103. The LSI drive circuit 112, thermal resistors 116, and conductors 118 and 117 are then formed on the substrate 109. A water-resistant cover material 115, such as a film resist or a polyimide with good water resistant properties, is adhered to the surface of the silicon wafer with the common ink channel 111 formed therein. The water-resistant cover material 115 is formed and positioned so as to cover the drive LSI device 112 and acts as a passivation layer against the water or oil based ink to be ejected. The cover material 115 is removed from areas corresponding to the common ink channel 111 and the ink chambers 113 by exposure and development. Afterward the remaining cover material is hardened to form the partition member 115. An approximately 50 μm thick PET film 114 is adhered to the partition 115 using ultraviolet hardening adhesive. A row of nozzles 102 are then dry etched into the PET film 114. The silicon wafer is then cut to a predetermined size and mounted to the head mounting frame 103 to form the completed head 1 shown in FIG. 8. It is preferable to remove photoresist and PET film where the silicon wafer is to be cut at the time of photoetching.

Figure 10:
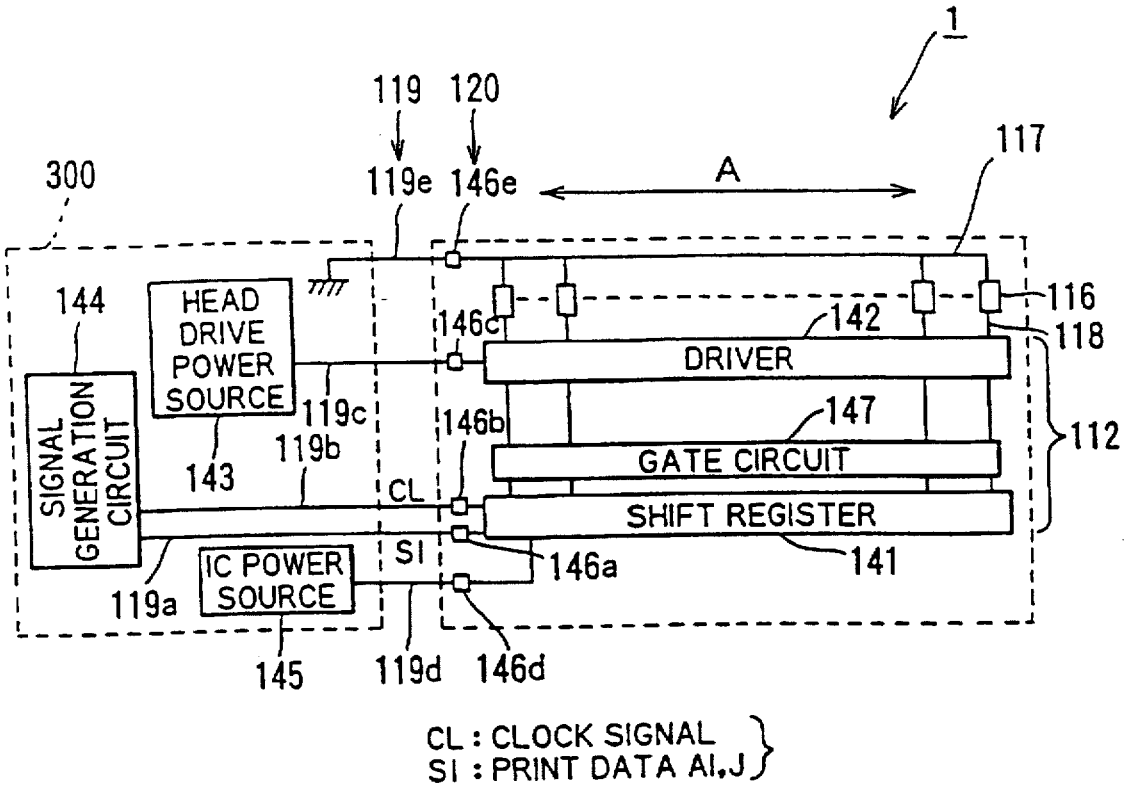
FIG. 10 is a block diagram showing circuitry of the print head shown in FIGS. 8 and 9 and a head drive circuit for driving the print head.

As shown in FIG. 10, the above-described print head 1 of FIGS. 8 and 9 is connected to a head drive circuit 300 for driving the print head 1. The head drive circuit 300 includes a head drive power source 143, a signal generation circuit 144 for generating a binary print data signal and a clock signal, and a large scale integrated circuit (LSI) power source 145. The drive LSI circuit 112 in the print head 1 includes a shift register 141, a driver circuit 142 and a gate circuit 147 connecting the shift register 141 to the driver circuit 142. Wiring 119 for connecting the head drive circuit 300 to the print head 1 for serially driving the thermal resistors 116 in all the ink chambers 113 is constructed from only five lines: a data line **119*a*, a clock line 119*b*, a driver circuit power source line 119*c*, a LSI device power source line 119*d*, and a ground line 119*e*. The data line 119*a* is provided for serially sending the binary print data from the signal generation circuit 144 to the shift register 141. The clock line 119*b* is provided for transmitting the clock signal from the signal generation circuit 144 to the shift register 141. The driver circuit power source line 119*c* is provided for connecting the head drive power source 143 to the driver 142. The LSI device power source line 119*d* is provided for connecting the LSI power source 145 to the shift register 141. It is noted that the LSI drive circuit 112 has five pedestals or terminals 146*a* through 146*e* on one end of the silicon substrate 109, at which the five wires 119*a* through 119*e* are connected to the LSI drive circuit 112**.

The ink jet print head 1 having the above-described structure uses a serial consecutive drive. Therefore the drive LSI circuit 112 requires no latch circuit as do drive LSI circuits of conventional printers which use block drive. In a conventional thermal ink jet print head, a latch circuit is provided between the shift resistor and the driver. A timing generation circuit must also be added to the head drive circuit for the latch circuit. Additionally, two or three lines of wiring must be added to transmit signals to the head. Contrarily, according to this example, the print head 1 is driven by serially consecutive drive by the head drive circuit 300 as shown in FIG. 10. The print head 1 requires a smaller scale circuit, fewer lines of wiring, and can be produced at lower costs when compared to conventional printer head. In concrete terms, because only five signal wires for drive control are required per nozzle row, mounting costs of the head are reduced.

Figure 11:
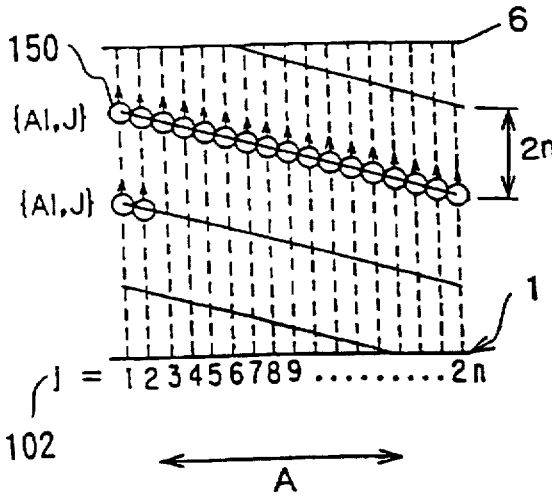
FIG. 11 (*a*) is a top view showing a pattern formed by ink droplets ejected using the circuitry shown in FIG. 10.
Figure 11:
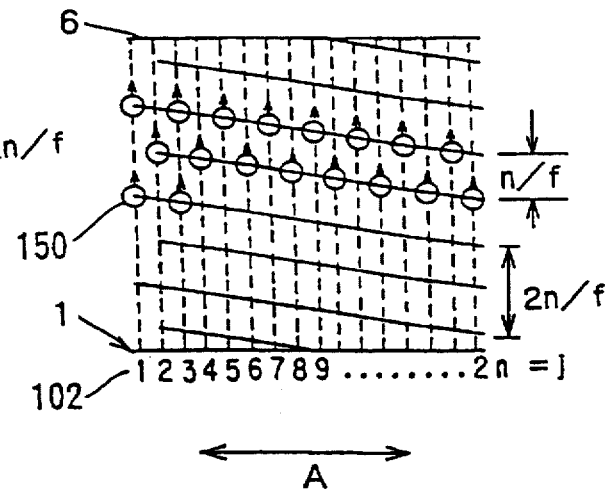

The following text will describe, in greater detail, the serially consecutive drive method employed in the present invention, while referring to FIGS. 10 and 11 (*a*). It is noted that during this serial consecutive drive method, as shown in FIG. 1, the print sheet 6 is moved relative to the print head 1 in the transport direction (i.e., auxiliary scanning direction) B approximately perpendicular to the main scanning direction A, that is, perpendicular to the row of nozzles 102 in the head 1. In this example, the head 1 is stationary and the print sheet 6 is transported continually at a set speed.

The signal generation circuit 144 is controlled, by a CPU (not shown) provided in the head drive circuit 300, to serially and consecutively generate a series of binary print data $(A_{i,j})_{j=1 \text{ to } 2n}$ for producing each line (i-th line where i=1, 2, . . . ) extending in the main scanning direction A on the sheet 6. The series of print data $(A_{i,j})_{j=1 \text{ to } 2n}$ include 2n print data $A_{i,j}$ where j=1, 2, . . . , 2n. Each print data $A_{i,j}$ includes print information on each dot j of 2n dots to be printed on the corresponding i-th line, where 2n is the total number of the nozzles 102 formed in one row of the print head 1. The series of binary data $(A_{i,j})_{j=1 \text{ to } 2n}$ are serially and consecutively transmitted to the shift register 141 via the data line 119*a*.

As shown in FIG. 10, the shift register 141 has 2n register elements aligned in the main scanning direction A. The gate circuit 147 has 2n gates aligned in the main scanning direction, and the driver 142 has 2n portions aligned in the main scanning direction. The 2n portions of the driver 142 serve to respectively drive the 2n thermal resistors 116 aligned in the main scanning direction A. Each register element (j-th register element) is connected via a corresponding gate (j-th gate) in the gate circuit 147 to a corresponding portion (j-th portion) of the driver 142. The j-th portion of the driver 142 is for driving a corresponding j-th thermal resistor 116 to print a j-th dot on the corresponding i-th line on the sheet 6.

The shift register 141 shifts the received print data $A_{i,j}$ from one register element to a next register element in the main scanning direction of FIG. 10, synchronously with the clock signals CL supplied to the shift register 141 from the signal generation circuit 144. Accordingly, at the time when a j-th clock signal $CL_j$ is inputted to the shift register 141, a j-th print data $A_{i,j}$ properly reaches a corresponding j-th register element.

The shift register 141 is constructed to output the print data to the gate circuit 147, synchronously with the received clock signals CL. The shift register 141 can therefore send out the print data, as located in the respective register elements at the time when the shift register 141 receives the clock signals CL, toward the corresponding gates in the gate circuit 147.

The gate circuit 147 is constructed so that each j-th gate is opened only at the time when the corresponding j-th clock signal $CL_j$ is supplied via the shift register 141 to the gate circuit 147. Accordingly, the gate circuit 147 can supply each j-th print data $A_{i,j}$ to the drive circuit 142 only at the time when the j-th print data $A_{i,j}$ is located in the corresponding j-th register element in the shift register 141. Thus, the gate circuit 147 can send out each j-th print data $A_{i,j}$ properly to the corresponding j-th portion of the driver 142. The j-th portion of the driver 142 therefore properly drives the j-th thermal resistor 116 to print the j-th dot, in accordance with the j-th print data $A_{i,j}$.

Because the shifting operation by the shift register 141 successively supplies the series of print data $A_{i,j}$ to the corresponding j-th shifting elements, the gate circuit 147 can successively supply the series of print data $A_{i,j}$ to the corresponding j-th portions of the driver 142 so as to successively drive the j-th thermal heaters 116.

Thus, the shift register 141 and the gate circuit 147 cooperate to serially output the series of print data $(A_{i,j})_{j=1 \text{ to } 2n}$ to the corresponding j-th portions of the driver 142, in synchronism with the clock signals. When the print data $A_{i,j}$ is an ejection signal (i.e., is 1), the corresponding j-th portion of the driver 142 applies a voltage at a predetermined pulse width to the corresponding j-th thermal resistor 116, thereby causing the thermal resistor 116 to heat. If print data $A_{i,j}$ is not an ejection signal (i.e., is 0), the voltage is not applied. When all dots j of one line i have been printed (i.e., $A_{i,j}$ for j=1 to 2n have all been processed), print drive continues for the next line i+1 (i.e., $A_{i,j}$ where j=1 to 2n). In more concrete terms, the signal generation circuit 144 serially outputs the next series of print data $(A_{i+1,j})_{j=1 \text{ to } 2n}$ and the shift register 141 and the gate circuit 147 cooperate to serially output the print data $(A_{i,j})_{j=1 \text{ to } 2n}$ to the corresponding thermal elements 116. When all the signals $A_{i,j}$ (j=1 to 2n) for one line i are 1 to drive all the nozzles 102 on the print head 1 to eject ink droplets 150, the pattern of ink droplets produced on the sheet 6 appears as shown in FIG. 11(*a*).

As described above, printing while feeding the print sheet at a continuous speed becomes possible with the print head of the present example. Continuous-speed feed of the print sheet is better suited for high-speed printing and is also technically easier than is step feed.

Figure 13:
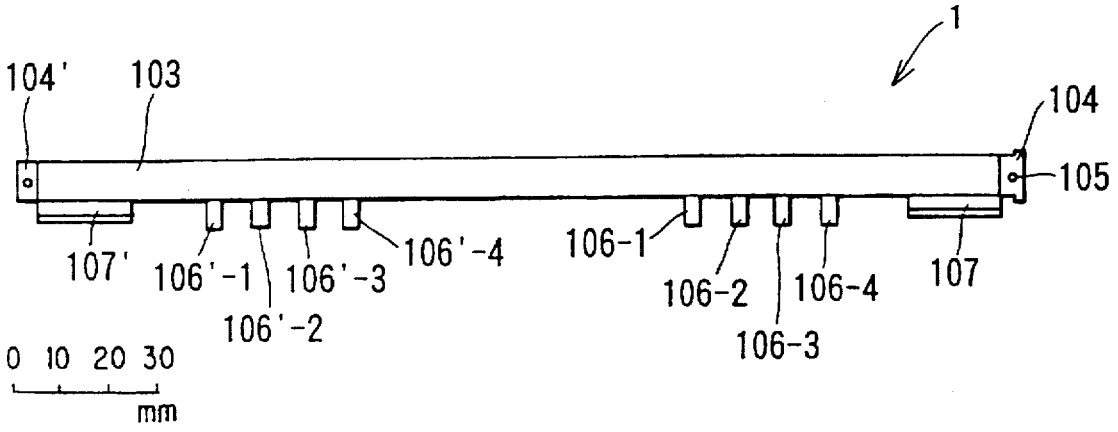
FIG. 13 is a side view showing the line head shown in FIG. 12.
Figure 14:
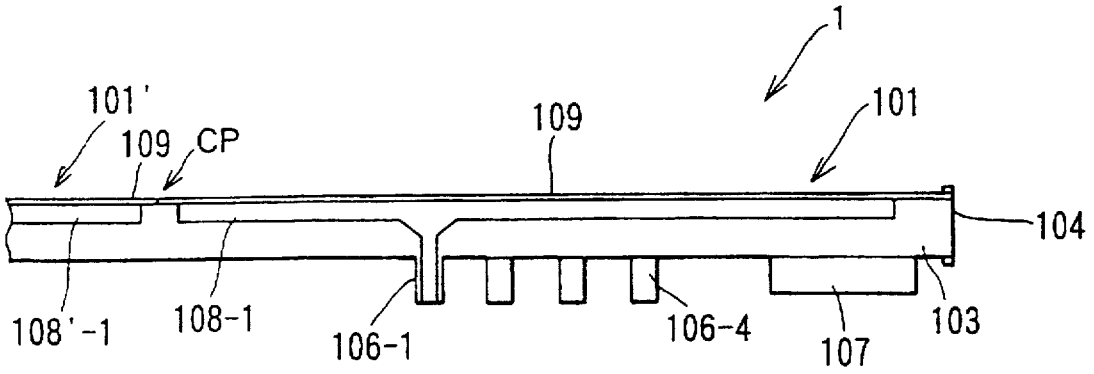
FIG. 14 is a side sectional view showing internal structure of the line head shown in FIG. 12 taken along a line XIV—XIV.
Figure 15:
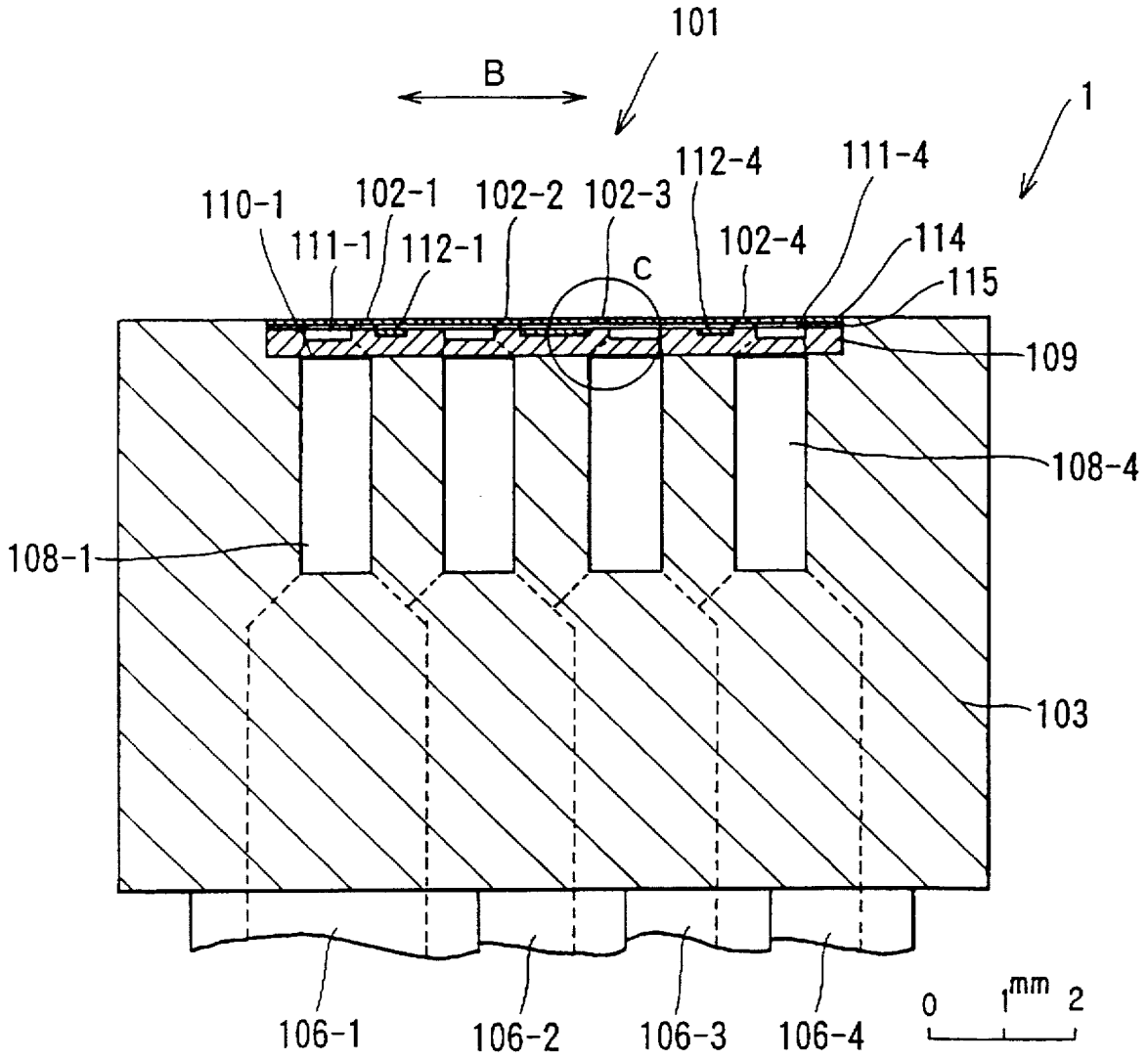
FIG. 15 is a cross-sectional view showing the line head shown in FIG. 12 taken along a line XV—XV.

FIGS. 12 through 15 show an overall structure of a full-color line head 1 which has the above-described basic structure and which is especially suited for the ink jet printer of the present invention. In order to produce this line head 1, as shown in FIG. 15, the monolithic drive portion 101 is formed with four rows of common ink channels 111-1, 111-2, 111-3 and 111-4 for black ink, yellow ink, cyan ink and magenta ink, respectively. Four sets of connection holes 110-1, 110-2, 110-3 and 110-4 are formed to fluidly connect with the common ink channels 111-1, 111-2, 111-3 and 111-4, respectively. Each set of the connection holes 110-1, 110-2, 110-3 and 110-4 includes a plurality of connection holes aligned intermittently in the main scanning direction A, in the same manner as the connection holes 110 of FIGS. 8 and 9.

Four rows of ink droplet generators are provided in connection with the common ink channels 111-1, 111-2, 111-3 and 111-4, respectively. Each row of the four rows of ink droplet generators includes a plurality of ink droplet generators aligned in the main scanning direction A. Similarly to the ink droplet generator shown in FIG. 8, each ink droplet generator includes an ink chamber 113, a thermal resistor 116 and conductors 117 and 118 connected to the thermal resistor 116, and a nozzle 102. Accordingly, four nozzle rows 102-1, 102-2, 102-3 and 102-4 are arranged in the transport direction B on a surface of the monolithic drive portion 101 so as to confront the vacuum suction transport device 3. Four sets of drive LSI circuits 112-1, 112-2, 112-3 and 112-4 are provided adjacent to the four rows of ink droplet generators. Each of the drive LSI circuits 112-1, 112-2, 112-3 and 112-4 is constructed as shown in FIG. 10 for performing the serial conductive drive.

As apparent from the above, the structure of the monolithic driving section 101 shown in FIG. 15 is substantially constructed from four monolithic driving sections 101 described with reference to FIGS. 8 and 9 that are arranged in the auxiliary scanning direction B. Accordingly, an enlarged view encircled in C. in FIG. 15 is equivalent to the view of FIG. 8.

Figure 12:
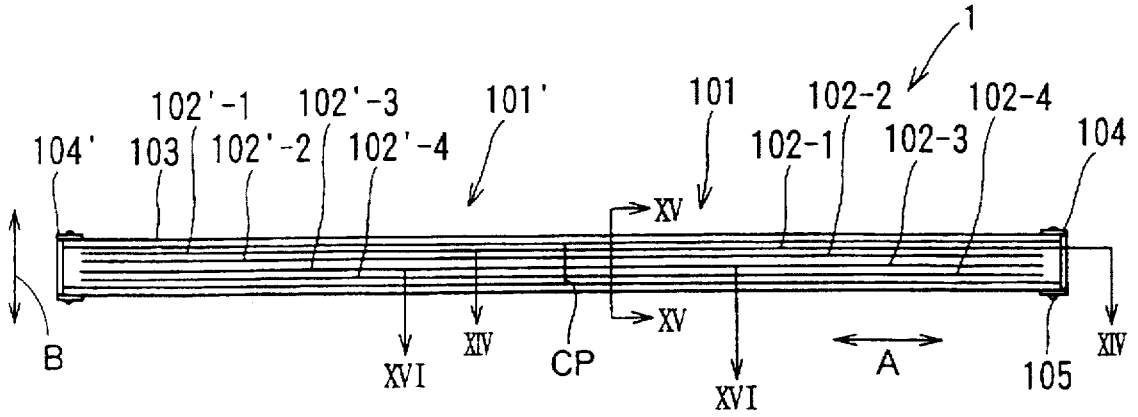
FIG. 12 is a top view showing a full-color line head suitably employed in the ink jet printer according to the present invention.

The above-described monolithic driving section 101 and another monolithic driving section 101' having the same structure of the monolithic driving section 101 are mounted on a single mount frame 103 so that each row of the four rows of nozzles 102-1, 102-2, 102-3 and 102-4 formed on the driving section 101 and each row of the four rows of nozzles 102'-1, 102'-2, 102'-3 and 102'-4 formed on the driving section 101' are arranged in line, as shown in FIG. 12.

As shown in FIG. 15, the mounting frame 103 is formed with a set of four ink supply channels 108-1, 108-2, 108-3 and 108-4 arranged in the auxiliary scanning direction B communicated with respective connection holes of the sets of connection holes 110-1, 110-2, 110-3 and 110-4 of the monolithic driving section 101. Therefore, a sufficient amount of ink from the ink supply channels 108-1 through 108-4 can be supplied to respective common ink channels 111-1 through 111-4 via respective connection holes 110-1 through 110-4. The mounting frame 103 is further formed with another set of four ink supply channels 108'-1, 108'-2, 108'-3 and 108'-4 arranged in the auxiliary scanning direction B communicated with the connection holes 110'-1, 110'-2, 110'-3 and 110'-4 of the monolithic driving section 101'. As shown in FIGS. 13 and 14, the mounting frame 103 is provided, at its reverse side, with one set of ink supply ports 106-1, 106-2, 106-3 and 106-4 for respectively supplying ink to the set of four ink supply channels 108-1, 108-2, 108-3 and 108-4. The mounting frame 103 is provided with another set of ink supply ports 106'-1, 106'-2, 106'-3 and 106'-4 for respectively supplying ink to the set of four ink supply channels 108'-1, 108'-2, 108'-3 and 108'-4. Therefore, the four colors of ink supplied from the ink supply ports 106 and 106' will not mix and a sufficient and necessary amount of ink can be supplied to each of the common ink channels 111-1 and 111'-1 through 111-4 and 111'-4.

When the line head as shown in FIGS. 12–15 is employed as the print head 1 in the printer of the present invention, the print head 1 is provided as shown in FIG. 1 so that the nozzle rows 102-1, 102'-1, 102-2, 102'-2, 102-3, 102'-3, 102-4, and 102'-4 confront the vacuum suction transport device 3. The print head 1 is oriented so that each of the rows extends perpendicularly to the transport direction B.

A concrete example of the line head having the above-described structure will be described below.

The two monolithic driving sections 101 and 101' are mounted centered on the mounting frame 103 made from Fe-42Ni alloy using die bonding techniques. The monolithic driving sections 101 and 101' are connected at a connection portion CP. The two monolithic driving sections 101 and 101' are formed from equal approximately 107 mm by 8 mm sections of silicon wafers 109 and 109'. The two monolithic driving sections 101 and 101' therefore have a total 214 mm length L when connected. Two monolithic sections 101 and 101' are necessary because a maximum length of only 140 mm for a head can be produced from a single six inch wafer. The head mounting frame 103 is made from Fe-42Ni alloy because the expansion coefficient of Fe-42Ni alloy is substantially the same as that of silicon. A layer of nickel is provided to the entire surface of the print head by plating to give the print head good anti-corrosion properties.

As described above, four rows of nozzles 102 are provided in the line head: black nozzle row 102-1 and 102'-1, yellow nozzle row 102-2 and 102'-2, cyan nozzle row 102-3 and 102'-3, and magenta nozzle row 102-4 and 102'-4. Each row of nozzles on each monolithic driving section 101 (or 101') contains 1,512 nozzles. Because the two monolithic sections 101 and 101' are connected at the connection portion CP, the distance between the connection portion CP and the end nozzle nearest the connection portion CP limits the pitch and dot density of the line head 1. The line head of this example has the nozzles arranged with a pitch of (1070) in the main scanning direction and therefore attains a dot density of 360 dots per inch (dpi). The line head 1 therefore contains a total of 3,024 nozzles for each color nozzle row which extends in a length of 210 mm.

It is noted that the monolithic sections 101 and 101' can be connected at a side edge rather than the tip edge CP to eliminate this limitation to the pitch of the nozzles. In this case the monolithic sections 101 and 101' would be shifted relative to each other in the widthwise direction by the width of the substrate sections 101 and 101' and then would be positioned so as to overlapped on an edge side.

As described already, according to the present example, five wires 119 (shown in FIG. 8) are provided to transmit signals and power to the 1,512 ink droplet generators in each row of each of the monolithic driving sections 101 and 101'. Therefore, a total of twenty wires 119 are provided for all four rows of ink droplet generators of each driving section 101 or 101'. In this concrete example, the mounting frame 103 is provided, at its back side, with a pair of connectors 107 and 107' for supplying electric signals toward the drive LSI circuits 112-1, 112-2, 112-3 and 112-4 on the monolithic section 101 and 112'-1, 112'-2, 112'-3 and 112'-4 on the monolithic section 101, respectively. In the monolithic section 101, the drive LSI circuits 112-1, 112-2, 112-3 and 112-4 are formed with the total of twenty pedestals or terminals 146 on the silicon substrate 109 at its one end opposed to the connection portion CP. Similarly, in the monolithic section 101', the drive LSI circuits 112'-1, 112'2-2, 112'-3 and 112'-4 are formed with the total of twenty pedestals or terminals 146' on the silicon substrate 109' at its one end opposed to the connection portion CP. The total of twenty wires 119 (or 119') are connected at one end to the twenty pedestals 146 (or 146') on the substrate 109 (or 109'), and are connected at other end to the connectors 107 (or 107). The twenty wires 119 (or 119') therefore serve to send the external control signal from the head driving circuit 300 received at the connectors 107 (or 107') to the twenty pedestals 146 (or 146') of the drive LSI circuits 101 (or 101'). The twenty wires 119 are held in a tape carrier (not shown), and the twenty wires 119' are held in another tape carrier (not shown). The two tape carriers 119 and 119' thus provided at opposite ends of the line head 1 are covered with press clasps 104 and 104' to be fixed to the opposite ends.

The 8 mm width of each of the monolithic sections 101 and 101' allows connecting the twenty wires 119 and 119' to the twenty pedestals provided at the end of the sections 101 and 101' at a density of about 3 lines/mm. Connecting lines at this density is easily performed with conventional mounting techniques. In comparison, using conventional techniques would require about 6,000 wire bonding processes to connect one half of the head. Additionally, nozzle rows would have to be bridged with connection lines which is technically impossible.

In the line head of this example, each of the drive LSI circuits 112-1, 112-2, 112-3 and 112-4 and 112'-1, 112'-2, 112'-3 and 112'-4 of the monolithic driving sections 101 and 101' is constructed as shown in FIG. 10 for performing the serial consecutive drive. All ink droplet generators in the line head 1 are caused to eject ink droplets to print 3,024 dots/line in 500 μs (2 kHz), for example. Therefore an entire A4sheet can be printed in about two seconds or about 30 A4 size sheets per minute. The ejection frequency can be increased to a maximum of 5 KHz, thus allowing a print speed of 60 ppm (page per minute). Using the pump heaters described in co-pending U.S. patent application Ser. No. 068,348 is also an effective way to increase print speed. Details of the pump heaters is described in the application Ser. No. 068,348, the disclosure of which is hereby incorporated by reference.

If the width of the pulse of voltage applied to each thermal resistor is 1 μs, only six ink droplet generators or less are at some stage of having the 1 μs pulse applied to the thermal resistor 116 thereof at any one time (3,024 dots/500 μs=6 dots). When driving the head in this way, 0.5 W/dot is required for energizing each thermal resistor to eject each ink droplet. Therefore, the maximum energy that will need to be applied at any one time is less than three watts/line (i.e., 12 watts or less/line for full color print).

It is noted that when printing while driving the line head serially and consecutively, and feeding the sheet at a continuous speed as described above, each printed line on the sheet slants only one dot width, that is, a 60 to 70 μm shift per line at 360 dpi. The shift is only 30 to 40 μm with the print head 1 described in this concrete example because the line head 1 is constructed by two driving sections 101 and 101'. Slanting of printed rows formed during serial consecutive ejection of ink can be corrected by slanting the head itself the same amount as the slant of the printed rows. This can be done by producing the head substrate with a slanted arrangement. Although ink droplets will deform about 1 μm when impinged on the print sheet, this is insignificant compared to the 60 to 70 μm diameter of printed dots.

A line head as shown in FIGS. 12 through 15 was manufactured as per the above description, filled with ink and used to print an image by drive signals transmitted via the connectors 107 and 107'. The conditions of the drive are shown in the Table 2.

TABLE 2

| Aspect | Drive Condition |
|---|---|
| Applied pulse width | 1 μs |
| Applied power | 0.5 W/dot |
| Ejection freguency | 2 KHz |
| Dot scanning speed | 3 MHz × 2/color |
| Maximum number of dots driven simultaneously | 3 dots × 2 × 4/color |
| Maximum power consumption | 12 W or less |
| Print speed (for full color) | 2 sec/A4 |
| Sheet transport speed | 150 mm/sec (at continuous speed) |

The drive conditions shown in Table 2 are for when the monolithic driving sections 101 and 101' of the print head are driven separately. In this case, the serial continuous drive starts at the far left (as seen in FIG. 12) ink droplet generators of both the monolithic sections 101 and 101' and scans across the monolithic sections 101 and 101' separately at a scanning speed of 3 MHz. Alternately, the two driving sections 101 and 101' could be driven as a single driving section that is serially continuously driven at a scanning speed of 6 MHz from the far left hand ink droplet generator of monolithic section 101'. In this second method all drive conditions except the scanning speed are the same as shown in Table 2. The slant of printed rows will be an insignificant 60 to 70 μm.

Printing while feeding the print sheet at a continuous speed is possible with the present invention. Continuous-speed feed of the print sheet is better suited for high-speed printing and is also technically easier than is step feed. Even if the cycle for ejecting ink is only 2 kHz, an entire A4 size sheet can be printed in full color in about two seconds. Continuous-speed feed of the print sheet allows printing of high quality images inexpensively. A full color image printed at high speeds using this print head has an appearance equivalent to a full color photograph. A print head according to the present invention can also be produced for making B4 size full color images, with using a 6 inch silicon wafer.

Serially driving the head eliminates problems that can arise when the 3,024 thermal resistors per line are simultaneously or block driven, problems such as the capacity of thin films, especially of the common wiring conductors, being easily exceeded or the maximum power requirement of the head being excessively large. For example, the maximum power requirement could be reduced to ½ or ⅓. The drive circuit can also be simplified to thereby reduce production costs to about ⅔. The number of wiring operations can be decreased from the 88 to 1,513 wirings required in conventional print heads to only five.

Copending U.S. patent application Ser. No. 068,348 describes that the protection-layerless thermal resistor formed from the Cr—Si—SiO alloy thin film resistor 116 and nickel conductors 117 and 118 efficiently heats ink in the ink chamber when applied with an extremely short, i.e., 1 μs or less, pulse of voltage. The energy required to eject one droplet is ⅓oth to ⅙ocompared to conventional thermal resistors that have protection layers. Even when not considering the heat removed with ejected ink, the temperature of the head rises 1° C. or less per every A4 size sheet printed solid with four colors. Because so little energy is needed for printing with the print head according to the present invention, the amount of heat energy removed with ejected ink is relatively large. Therefore, the temperature of the print head rises 10° C. or less even when 100 sheets are printed consecutively in full color. By adding heat fins to the heat mounting frame 103, cooling or other temperature control becomes unnecessary even during continuous high-speed operation. Conventionally it has proven difficult to perform continuous high-speed print because most of the 30 to 60 times more energy required for driving conventional heads goes mainly to heating the head.

In the above-described full color line head 1, two monolithic driving sections 101 and 101' each having four rows of ink droplet generators are mounted on the mounting frame 103. However, such a full color line head can be produced by mounting, on the frame 103, two sets of four monolithic driving sections each having a single row of ink droplet generators and therefore having the structure shown in FIGS. 8 and 9. The two sets of monolithic driving sections are arranged on the frame 103 in the main scanning direction where each set having the four driving sections arranged in the auxiliary scanning direction. As a result, four rows of nozzles are obtained as shown in FIG. 12.

In a test, a line head 1 for full color print of A4 size sheets was produced from eight 2 mm wide monolithic driving sections for single color print, i.e., eight monolithic driving sections with only a single row of orifices. The precision of the external dimension when cutting the substrates 109 for each monolithic driving section from a silicon wafer was kept to within ±3 μm through full dicing operation. Thus obtained eight single color monolithic driving sections were arranged on the head mounting frame 3 and connected using die bonding techniques. It is noted that adhesive got in between the monolithic chips and error was generated in the distance between lines to produce a maximum variance of 20 μm between extreme positions in the line. By controlling the timing of ejections, the variance in position was sufficiently corrected to print an image with appearance substantially the same as that obtained from the four color line head 1 of the previously-described concrete example. The amount of correction depends on the amount of deviation caused during assembly and the timing of the line drive should be shifted by 7 μs for every variance. Adjustments for correction were performed using a test image for such adjustments.

The print head structure shown in FIGS. 8 and 9 may also be applied to a scanning type head scanningly movable in the main scanning direction across the width of a sheet. The scanning type head has the same structure as that of the line head except that it is formed so that its length is less than the width of a sheet to be printed on (an A4 size sheet, for example) and that it is mounted to a carriage movable in the main scanning direction. The above-described A4 length line head could be mounted to the carriage so as to be scanningly movable in the main scanning direction when an A3 size or larger sheet is to be printed on. Slanting of printed rows formed during serial consecutive ejection of ink can be corrected by slanting the main scanning direction of the print head.

As described above, the line head of the present example can achieve an extremely rapid printing speed, i.e., a four color image on a sheet transported at a speed of 150 mm/sec with ejection frequency of 2 KHz. Accordingly, the line head of the present example may preferably be combined with the preheating unit 2 and the vacuum suction transport device 3 shown in FIG. 1. Thus combining these components to the line head can allow the printing liquid, or ink, impinged on the sheet to have sufficient time to dry during sheet transport. The printer provided with the combination of the preheating unit 2, the vacuum suction transport device 3, and the line head 1 of FIGS. 12–15 can obtain an image with good appearance while maintaining the extremely rapid printing speed and preventing blurring of images.

According to the above-described print head, the monolithic driving section 101 is provided with a large number of nozzles 102 with high density. The drive LSI circuit 112 serially and consecutively drives the plurality of ink droplet generators so as to eject ink droplets from corresponding nozzles 102, as shown in FIG. 11(*a*). Each of the plurality of ink droplet generators ejects an ink droplet so that the ejected ink droplet may fly in a direction toward the sheet 6 at an ejection speed of V (about 10 m/s, for example). Thus ejected ink droplet has a spherical or slightly elongated shape in the flying direction. The ink droplet has a length or dimension L (40 to 50 μm, for example) in the flying direction. If the distance D between corresponding points, i.e., lead point and lead point or center and center, of ink droplets ejected from adjacent nozzles is substantially equal to or lower than the length L of the ink droplet, there is high possibility that the ink droplets may couple while flying toward the sheet 6, due to slight inaccuracies in their ejection or flying direction. Because these inaccuracies in the ejection direction become large after consecutive printing over a long period of time, the possibility of the ink-flight coupling increases after the consecutive long period printing operation. This ink-flight coupling may result in a decrease in quality of printed images.

In order to prevent the ink droplets ejected from adjacent nozzles from coupling in flight, the shift register 141 may preferably be controlled to output the print data $A_{i,j}$ serially and consecutively to the drive circuit 142, with a phase difference T defined by an equation T=D/V having at least higher than L/V. That is, the phase difference T preferably satisfies an inequality T>L/V. The drive circuit 142 serially and consecutively drives the plurality of ink droplet generators with the phase difference T.

For example, when ink droplets have a spherical shape with a diameter L of about 40 to 50 μm and are ejected at V of about 10 m/s, the phase difference should be set at least higher than 4 to 5 μs to attain the distance D between corresponding points of ink droplets of greater than 40 to 50 μm. It is noted that ink droplets are usually slightly elongated in the flying direction to have a length L of about 100 μm, for example. Accordingly, the phase difference is preferably set to 10 μs or more which can obtain the distance D of 100 μm or more, to thereby largely reduce the possibility of the ink-flight coupling for the ink droplets. To completely eliminate the risk of ink-flight coupling even when ink droplets are greatly elongated in flight, the phase difference may preferably be increased to 30 to 50 μs.

In the concrete example of the ink jet print head 1 as shown in FIG. 12, ejected ink droplets have a spherical shape with a diameter of between 40 and 50 μm on average. If the distance between corresponding points, i.e., lead point and lead point or center and center, of ink droplets ejected from adjacent ink droplet generators is equal to or higher than about 40 to 50 μm, the possibility of the ink droplet coupling in flight increases. However, if the distance is lower than about 40 to 50 μm, the possibility decreases. It is noted that the ink droplets are usually slightly elongated in the flying direction to have length L of about between 100 μm to 130 μm. Accordingly, if the distance D is between 100 and 130 μm or more, the possibility of the ink droplets coupling in flight is reduced to near zero. In this concrete example, an ink droplet ejected from the head travels at a flight speed of about 13 m/sec. Thus, corresponding points of ink droplets ejected from adjacent ink droplet generators fired at a time phase difference of between 8 and 10 μs will be separated by about 100 to 130 μm. Accordingly, firings of adjacent ink droplet generators should preferably be adjusted between 8 and 10 μs or more. To completely eliminate the risk of ink-flight coupling, even when ink droplets are greatly elongated in flight, the time phase difference between firings of adjacent ink droplet generators can be increased to 30 to 50 μs. Consequently, quality of printed images will not drop even after consecutive printing over a long period of time. On the other hand, when the time phase difference between subsequent firings is less than 8 to 10 microseconds, quality of printed images can decrease due to in-flight coupling of droplets.

Accordingly, in the printer head 1 of this concrete example, the ink droplet generators are preferably driven serially with a phase difference of 10 μs or more.

Alternatively, if it is necessary or desirable to serially drive the ink droplet generators to be driven with a phase difference of 10 μs or less, print data $A_{i,j}$ for driving the ink droplet generators are preferably restructured so as to cause adjacent ink droplet generators to be fired with a phase difference of 10 μs or more.

Below will be given a concrete example of a method for reconstructing the print data $A_{i,j}$ so as to prevent the ink-flight coupling of ink droplets at high print speed (that is, at a small phase difference of 10 μs or more, for example).

In this example, the alignment of print data ($A_{i,j}$) transmitted to the head, and also the clock signal for transmitting print data according thereto, are transformed or changed to prevent decreases in quality of printed images. Driving the head with the drive method according to this example will cause ink droplets to be ejected in the pattern shown in FIG. 11(*b*).

This drive method will be described in greater detail, below.

Assume that the signal generation circuit 144 of FIG. 10 is controlled, by the CPU provided in the head driving circuit 300, to supply the clock signals CL at frequency of f [Hz] to the shift register 141. (It is noted that the data generator 144 is also controlled to input the series of print data $A_{i,j}$ to the shift register 141 at the normal speed, i.e., frequency f.) In this case, the shift register 141 and the gate circuit 147 cooperate to serially or scanningly supply the series of print data $A_{i,j}$ to the corresponding ink droplet generators every 1/f [seconds]. Accordingly, the 2n ink droplet generators can be serially or scanningly fired every 1/f [seconds]. In other words, the time phase difference between firings of adjacent ink droplet generators is 1/f [seconds]. If $A_{i,j}$ for each line i are all 1, the ink droplets are ejected in the pattern as shown in FIG. 11(*a*).

When the time phase difference 1/f between subsequent firings at adjacent ink droplet generators is small, for example, less than 8 to 10 μs, it becomes necessary to prevent ink-flight coupling of ink droplets. In this case, according to the present invention, the print data generator 144 is controlled by the CPU to change the frequency of the clock signals CL to be set at 2f [Hz]. The print data generator 144 is further controlled by the CPU to transform one series of print data ($A_{i,j}$) where j=1 to 2n for each line i into two series of print data $(A_{i,2j-1}, 0)_{j=1 \text{ to } n}$ and $(0, A_{i,2j})_{j=1 \text{ to } n}$. The set of print data $(A_{i,2j-1}, 0)_{j=1 \text{ to } n}$ includes 2n print data $A_{i,1}$, 0, $A_{i,3}$, 0, $A_{i,5}$, 0, . . . $A_{i,2n-1}$, 0, and the other set of print data $(0, A_{i,2j})_{j=1 \text{ to } n}$ includes 2n print data 0, $A_{i,2}$, 0, $A_{i,4}$, 0, $A_{i,6}$, . . . 0, and $A_{i,2n}$ where each print data $A_{i,k}$ (k=1 to 2n) is 0 (no ejection) or 1 (ejection). The print data generator 144 is controlled by the CPU to transfer the set of print data $(0, A_{i,2j})_{j=1 \text{ to } n}$ immediately after completion of the transfer of the set of print data $(A_{i,2j-1}, 0)_{j=1 \text{ to } n}$.

The above-described print data transformation is represented by the following formula:

$$(A_{i,j})_{j=1 \text{ to } 2n}=(A_{i,2j-1}, 0)_{j=1 \text{ to } n}+(0, A_{i,2j})_{j=1 \text{ to } n},$$

where $$(A_{i,2j-1}, 0)_{j=1 \text{ to } n}=A_{i,1}, 0, A_{i,3}, 0, A_{i,5}, 0, \ldots A_{i,2n-1}, 0,$$

$$(0, A_{i,2j})_{j=1 \text{ to } n}=0, A_{i,2}, 0, A_{i,4}, 0, A_{i,6}, \ldots 0, \text{ and } A_{i,2n}$$

To summarize, for every line i, 2n print data are divided between n number of odd and n number of even rows of data. Non-ejection data is inserted between each type of data to produce 2n number each of two print data rows. The shift register 141 and the gate circuit 147 are controlled to serially input the two series of print data $(A_{i,2j-1}, 0)_{j=1 \text{ to } n}$ and $(0, A_{i,2j})_{j=1 \text{ to } n}$ to the corresponding portions of the driver 142 at twice normal speed, i.e., frequency 2f, so that the number of the lines to be formed in the auxiliary scanning direction doubles. (It is noted that the data generator 144 is also controlled to input the two series of print data $(A_{i,2j-1}, 0)_{j=1 \text{ to } n}$ and $(0, A_{i,2j})_{j=1 \text{ to } n}$ to the shift register 141 at twice normal speed, i.e., frequency 2f.) Print data can easily be changed without increasing costs by using a portion of a signal process circuit, that is, the CPU provided in the head drive circuit 300. Doubling the clock frequency will not tax the capacity of the shift register 141 mounted to the head. Time to scan one line becomes n/f [seconds] and the ejection phase shift between adjacent ink droplets becomes:

$$1/2f+2n/2f=n/f.$$

For example, with a 64 nozzle/line serial scan type head provided with the structure shown in FIG. 8 operating under 640 KHz clock frequency to produce the droplet ejection pattern shown in FIG. 11(*a*), the phase shift between adjacent ink droplets becomes 1.56 microseconds ($1/64\times10^4$), thereby increasing the possibility of adjacent droplets coupling in flight. In contrast to this, the method resulting in the ink droplet pattern shown in FIG. 11(*b*) will result in a time phase difference between adjacent ink droplets of 50 μs ($1/2\times10^4$). The distance between droplets will therefore be 650 μm (13 m/sec×50 μs=650 μm), so that decreases in quality of the printed image can be completely prevented. The benefits of this method are even more striking with a large scale line head with 100 to 1,000 nozzles/line.

Rather than the drive method where every other droplet generator is driven, which will create the ink droplet pattern shown in FIG. 11(*b*), every third droplet generator can be driven. Other ejection methods can also be used as long as the time phase difference between ejections of adjacent droplet generators is 10 μs or more. Restructuring the drive signal to produce a phase shift of 20 microseconds or more is even more desirable.

A line head with 128 nozzles in a single row was built including ink droplet generators formed as shown in FIG. 8. Every other line of a print sheet transported in front of the head was printed black by serially and consecutively applying 1 μs pulses of voltage (1 W) to the thermal resistors of the ink droplet generators in the head. The quality of images printed at various ejection frequencies (in the range of 0.5 KHz to 5 KHz) and at various time phase differences between ejections of adjacent droplet generators (in the range of about 16 is to about 1.6 μs). A drop in the quality of printed images was only occasionally observed when the phase shift was 7 to 8 microseconds or more and only observed after printing had been performed over a long period of time. On the other hand, quality of printed images quickly dropped when the time phase difference was shortened, even after cleaning the nozzle surface of the head.

On the other hand, when the print head was driven using the drive method described in the concrete example of the above-described method with an ejection frequency of 5 KHz, good quality of printed images was maintained even after consecutive printing was performed for a long period of time. The same good printing results were observed when every third droplet generator was driven or when printing was performed with a large scale line head.

It can therefore be understood that driving a thermal ink jet printer by the serial consecutive drive described above can completely prevent the type of drop in quality of printed images that can be generated when ink is ejected from nozzles aligned in a high density. Also this can be achieved without increasing production costs. This driving method can be applied to a wide variety of print heads such as a serial scan type head with a total of 64 droplet generators or a line head with a total of 3,024 droplet generators (1,512×2).

The above-described drive method applied to a print head with the structure shown in FIG. 8, that is, a top-shooting type ink jet print head where ink droplets are ejected in a direction perpendicular to the thermal resistor surface. However, the present invention can be used with a type of head where the ink droplets are ejected in a direction parallel to the surface of the thermal resistor and obtain the same effects.

The pitch and dot density of the line head are determined by the distance between the connection portion CP and the end nozzles in the monolithic sections 101 and 101' formed nearest the connection portion CP. Therefore, producing the connection portion CP becomes increasingly difficult the greater the dot density. In order to facilitate producing the connection portion CP of the line head, the following modification of a line head can be provided.

Figure 16:
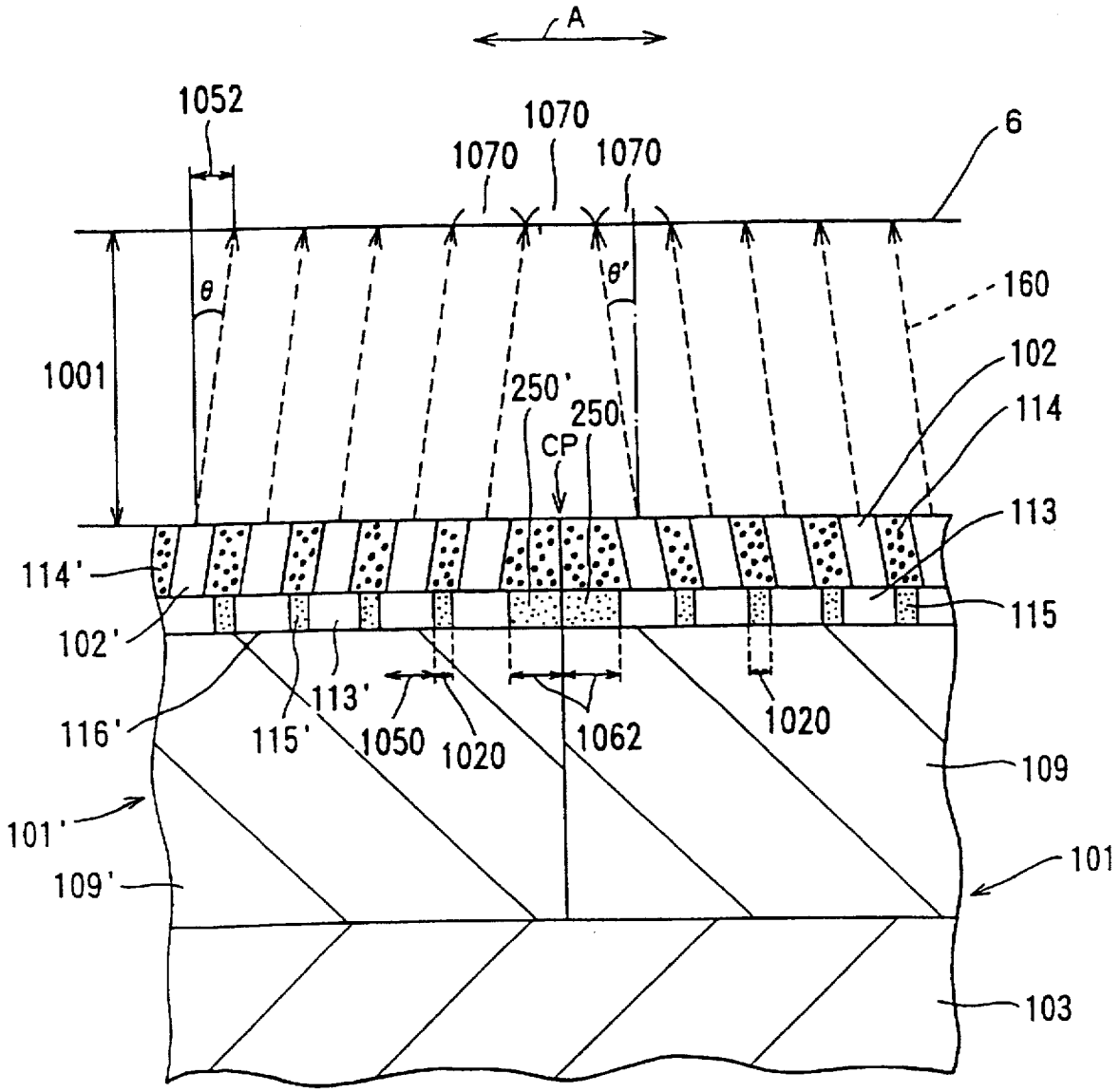
FIG. 16 is a cross sectional view of a modified line head which corresponds to the cross section of the line head described with reference to FIGS. 8 through 15 taken along a line XVI—XVI of FIG. 12 and taken along a line XVI—XVI of FIG. 8.

As shown in FIG. 16, a line head of this modification is formed similarly to the above-described example, except that in the line head of the present modification, angled nozzles 102 and 102' formed in nozzle plates 114 and 114' of monolithic sections 101 and 101' are angled slightly toward the connection portion CP' at an angle θ. The angle θ depends on the distance separating the nozzle plates 114 and 114' and the sheet 6 supported in front of the surface of the nozzle plates 114 and 114'. In the present modification, the nozzle plates 114 and 114' and the sheet 6 are separated by 1 mm, (1001) and therefore the angle θ is set at 3°. The angle θ of each angled nozzle is defined between a line following the axis of the angled nozzle and a line perpendicular to the surface of its respective nozzle plate. With this structure, even if the space between nozzles on either side of the connection portion CP is slightly greater than between other adjacent nozzles of the line head, the dot density of an image printed by the line head will be uniform. Forming the areas of the monolithic sections 101 and 101' near the connection portion CP, and aligning and assembling the monolithic sections 101 and 101' is easy.

The following is a description of a concrete example for producing a 369 dpi line head according to the present embodiment. This production method is similar to the concrete method described in the above-described example, except for production of the angled nozzles 102 and 102'. In the concrete example for producing the line head according to the present modification, a nozzle plate 114 is formed by first forming a film resist to a nickel plate to a thickness of 50 μm. Portions of the film resist are selectively exposed at an angle θ (for example, 3°) to form hardened column angled at the angle θ. The unexposed portions of the film resist are removed. Nickel is then plated to the nickel plate around the columns to a thickness of 40 to 45 μm. The resist columns are then removed to form the nozzles 102. The nickel plate is then lifted off, thereby forming the nozzle plate 114. In an alternative method, the nozzle plate 114 could be formed by exposing a light-sensitive glass, such as a PEG 3 glass ceramics produced by Hoya Corporation, at the angle θ. In this case, the nozzle plate 114 can be formed to 40 to 100 μm thickness. Next, another nozzle plate 114' is formed in the same manner by with angled nozzles 102' formed to an angle θ' equal but opposite to angle θ.

Partitions 115 and 115', and ink chambers 113 and 113', are then formed to substrates 109 and 109' respectively as described in the above example. The ink chambers 113 and 113' are formed with a width of 50 μm (1050). To produce a dot density of 360 dpi, the partitions 115 and 115' are formed with a width of 20 μm (1020). Connection areas 250 and 250', which will separate the monolithic sections 101 and 101' at the connection portion CP, are formed to a width of 62 μm (1062). The nozzle plates 114 and 114' are attached to partitions 115 and 115' respectively, and the resultant monolithic sections 101 and 101' are connected together at their connection surfaces to produce the connection portion CP. The connected monolithic sections 101 and 101' are then mounted to a mounting frame 103.

Ink droplets ejected from the angled nozzles 102 and 102' will follow respective flight paths 160 to reach the sheet 6 that is positioned away from the surface of the nozzle plate 114 with a distance of 1 mm. As shown in FIG. 16, flight paths 160 follow lines aligned with the axes of the angled nozzles 102 and 102'. The angles θ and θ' of the angled nozzles 102 and 102' create a shift of 52 μm (1052) between the position where ink droplets impinge on the sheet 6 by following the flight paths 160 and where a line that intersects line aligned with the axis of the angled nozzle and that is perpendicular to the nozzle plate surface intersects the sheet. This 52 μm shift allows forming each of the connection areas 250 and 250' to a width of 62 μm (52 μm+10 μm), which otherwise would need to be formed to a width of 10 μm to provide a uniform inter-nozzle distance of 20 μm (1020). The wider connection areas 250 and 250' facilitate cutting the edges of the monolithic sections 101 and 101'. Also the wide connection areas 250 and 250' are more reliable against pressure fluctuations in respective ink chambers. Connection and mounting processes are also facilitated. Actually, it is preferable to produce the connection areas 250 and 250' to have a width of about 50 to 55 μm and not 62 μm (1062) to the prevent modification of adhesive from effecting the width. Because the connection areas 250 and 250' must be formed with a minimum width of 20 μm (1020) and because the angle θ should be determined dependently on the distance between the nozzle plate 114 and the sheet 6, the angle θ can be within the range 0.5 to 10° with 3 to 6° most preferable. However, an angle θ much larger than this makes producing the nozzle plate 114 difficult.

Although the head described in this example is a single color head with only one row of angle nozzles 102 and 102', the same technology could be used to produce an integrated color head with a plurality of rows as shown in FIGS. 12–15.

Although in the head described in the present example the direction in which the ink is ejected is almost perpendicular to the thermal resistor surface, the ink ejection direction could be made parallel to the thermal resistor surface by using the same technology. In this case, compared to conventional technology where the ink chambers are provided at right angles to the surface of the nozzle plate, ink chambers are formed slanted at an appropriate angle of between 0.5 and 10°. The ink chambers are formed in the monolithic sections 101 and 101' so that when the monolithic sections 101 and 101' are joined together, their nozzles will slant in opposing directions. A head with this form can not be made into an integrated type head shown in FIG. 12 with a plurality of rows of nozzles in a single driving section, but several driving sections each with a single row of nozzles can be joined to form a full color head.

Copending U.S. patent application Ser. No. 08/068,348 describes that a thermal resistor made from a Ta—Si—SiO alloy thin film and a nickel thin film has virtually the same properties as the thermal resistor made from a Cr—Si—SiO alloy thin film and a nickel thin film. Details of the Ta—Si—SiO alloy thin film are described in Japanese Patent Publication Kokai No. SHO-62-167056. A line head of FIG. 12 was made, but using thermal resistors made from a Ta—Si—SiO alloy thin film and a nickel thin film. The head was evaluated under the same conditions as shown in Table 2. A full color image with quality the same as that produced by the head described in the already-described example was obtained.

Copending U.S. patent application Ser. No. 08/068,348 describes also that the good anti-corrosion and anti-cavitation properties of nickel make it a good conductor material to use in combination with a Cr—Si—SiO or a Ta—Si—SiO alloy thin film. However, there are limitations to producing nickel films. For example, a magnetron sputtering device with an especially strong magnetic field is necessary to produce a nickel film by sputtering because nickel has a strongly magnetic character. Also, nickel films require a separate process line from other semiconductor processes.

Copending U.S. patent application Ser. No. 068,348 also describes that tungsten also has excellent anti-corrosion properties. Tungsten may be used as a conductor material in the thermal resistors of the ink droplet generators in combination with a Cr—Si—SiO or a Ta—Si—SiO alloy thin film. To test the suitability of tungsten as a conductor material in the thermal resistors, print heads were produced with thermal resistors including tungsten conductors in combination with a Cr—Si—SiO or a Ta—Si—SiO alloy thin film. The reliability of the thermal resistor was tested in water. The thermal resistor successfully underwent one billion continuous applications of voltage in pulses to show that a tungsten thin film has anti-cavitation properties equivalent to those of a nickel thin film. Although tungsten has anti-corrosion properties slightly inferior to nickel, it is non-magnetic, so can be produced using a normal magnetron sputtering device and in the same process line as other semiconductor processes. Tungsten also has a lower electric resistance than nickel.

As described above, the monolithic section 101 of FIG. 8 for an ink jet head 1 allow producing an extremely small head at low costs. A color print head 1 for printing color images can be produced by providing ink generators in more than one row in the head. It is preferable that ink droplet generators of the color print head be formed with top-shooting type ink droplet generators. Because the print head 1 is integratedly formed with driver LSI circuit 112 and the thermal resistors 116, connection between the head 1 and the external drive circuit 300 is possible even with a large number of ink generators. The serial consecutive drive of the print head is more effective than conventional block or matrix drive. Because the print head 1 is driven serially and consecutively, the LSI circuit 112 integrated in the print head 1 can be made without a latch circuit, and therefore can be made smaller, less expensively, and with higher yields. Because a plurality of connection holes 110 for connecting the common ink channel 111 with the ink supply channel 108 in the mounting frame 103 are formed in the substrate 109 to be aligned intermittently in the main scanning direction, the resultant substrate 109 has sufficient structural strength. If the connection holes 110 are connected together to extend in the main scanning direction, the resultant substrate 109 would be structurally weak and so could easily break apart.

Thus, an ink jet print head having a plurality of nozzles in a high density and two dimensionally aligned to a large scale can be produced. The resultant head has a recording speed 10 to 100 times that of conventional ink jet recorders. The LSI circuit for driving the droplet generators in the head has only a shift register circuit and a driver circuit and requires only a total of five signal and power lines thereby decreasing costs. The present invention facilitates production of a line head compared to conventional technology. Continuous recording with the sheet transported at a uniform speed is possible, thereby facilitating transport of the sheet, reducing consumption of electricity, and negating any requirement for temperature control of the head. Because ink on the recorded sheet can be quickly dried, recording speed can be increased.

The print head 1 can be applied for recording all types of images including, but not limited to, characters, graphics, and pictures.

The structure of the LSI circuit 112 is not limited to that as shown in FIG. 10. The LSI circuit 112 may have various structures for attaining the serial and consecutive drive method with no latch circuit provided between the shift register 141 and the driver circuit 142.

The ink jet print head 1 may be provided with the structures disclosed in co-pending U.S. patent application Ser. Nos. 08/331,742, 08/387,579, and 08/405,709, the disclosures of which are hereby incorporated by reference.

As described above, in an ink jet printer of the present invention, a belt-type preheating unit pressingly heats a recording sheet while transporting the recording sheet in a transport direction on a belt. A suction transport device is positioned downstream of the belt-type preheating unit in the transport direction. The suction transport means transports, on its transport belt, the recording sheet heated by the belt-type preheating unit in the transport direction while fixing the recording sheet onto the transport belt by a vacuum suction. An ink jet print head, positioned confronting the suction transport device, records images by ejecting water-based ink onto the recording sheet which is being transported by the suction transport device. With this structure, the ink jet printer of the present invention can perform high quality printing operation at a high speed.

While the invention has been described in detail with reference to the specific embodiment thereof, it would be apparent to those skilled in the art that various changes and modifications may be made therein without departing from the spirit of the invention, the scope of which is defined by the attached claims.

What is claimed is:

1. An ink jet printer for printing ink onto a recording sheet, the ink jet printer comprising:

belt-type preheating means for pressingly heating a recording sheet while transporting the recording sheet in a transport direction;

suction transport means, positioned downstream of the belt-type preheating means in the transport direction, the suction transport means including a transport belt, the suction transport means transporting, on the transport belt, the recording sheet heated by the belt-type preheating means in the transport direction while fixing the heated recording sheet onto the transport belt by a vacuum suction; and ink ejection means located facing the heated recording sheet being transported on the suction transport means, said ink ejection means for recording images by ejecting water-based ink onto the heated recording sheet.

2. An ink jet printer of claim 1, wherein the belt-type preheating means includes:

a preheater for heating the recording sheet, the preheater having a heat source for generating heat, a belt mounted on the heat source in contact therewith, the belt transporting the recording sheet on one surface of the belt while contacting the heat source at the other surface, and a drive source for driving the belt; and a pressure roller positioned in contact with the belt for rotating synchronously with the belt driven by the drive source, the recording sheet being transported between the belt and the pressure roller while being pressed against the pressure roller, the belt transmitting heat from the heat source to the recording sheet.

3. An ink jet printer of claim 2, wherein the heat source includes:

a plurality of PTC heater chips arranged perpendicular to the transport direction; and a heat transmission plate provided over the plurality of PTC chips, the belt slides against the heat transmission plate at the one surface and transports the recording sheet on the other surface, the belt transmitting heat from the one surface contacted with the heat transmission plate to the other surface contacted with the recording sheet.

4. An ink jet printer of claim 3, wherein the heat transmission plate is made from zirconia-toughened alumina ceramics.

5. An ink jet printer of claim 4, wherein each of the plurality of PTC heater chips has a Curie temperature selected from a range of 120 degrees C. to 230 degrees C.

6. An ink jet printer of claim 4, wherein the heat transmission plate is thin enough to sufficiently transmit heat from the PTC heater chips to the belt.

7. An ink jet printer of claim 6, wherein the belt is formed from an endless belt made from a single layer of polyimide resin having a width in a range of 20 to 50 micrometer, and wherein the drive source includes a drive roller, the endless belt being mounted over both the heat source and the drive source.

8. An ink jet printer of claim 7, wherein the pressure roller is made from silicon rubber.

9. An ink jet printer of claim 8, wherein the pressure roller is soft enough to provide a large nip portion between the pressure roller and the belt of the preheater, at which the recording sheet is sandwiched while being transported by the belt.

10. An ink jet printer of claim 1, wherein the suction transport means includes:

a transport belt support for supporting the transport belt, the transport belt support having an outer wall, on which the transport belt slides to move in the transport direction, and an inner wall for defining a vacuum duct, the vacuum duct being communicated with an air suction pump, a plurality of openings being formed through the transport belt support from the inner wall to the outer wall, the suction being performed through the plurality of openings; and a drive source for driving the transport belt in the transport direction.

11. An ink jet printer of claim 10, wherein the suction transport means further includes adjusting means to produce a greater suction force on the heated recording sheet at a region facing the ink ejection means than a region downstream from the ink ejection means in the transport direction.

12. An ink jet printer of claim 11, wherein the density at which the openings are formed at the region confronting the ink ejection means is larger than that at the other region downstream from the ink ejection means in regards to the transport direction.

13. An ink jet printer of claim 12, wherein the drive source of the suction transport means is a drive roller, and wherein the transport belt is formed from an endless belt mounted over both the transport belt support and the drive roller, the endless belt sliding against the transport belt support on its one surface while transporting the recording sheet on its another surface, a plurality of pores being formed through the endless belt from its one surface to the other surface, the suction being provided from the vacuum duct to the recording sheet through both the openings formed through the transport belt support and the pores formed through the endless belt.

14. An ink jet printer of claim 13, wherein the endless belt is formed from a porous film.

15. An ink jet printer of claim 13, wherein the endless belt is formed from a mesh sheet.

16. An ink jet printer of claim 1, further comprising exhaust means provided adjacent to and downstream from the ink ejection means for exhausting air so as to suck water vapor released from the water-based ink impinged on the recording sheet.

17. An ink jet printer of claim 16, wherein the exhaust means is adjusted to produce a flow of air in a gap between the ink ejection means and the recording sheet so that the flow of air flows at two meters per second or less.

18. An ink jet printer of claim 17, wherein the exhaust means includes flow air adjusting means for adjusting flow of air in the gap between the ink ejection means and the recording sheet so that the flow of air is uniform across the width of the recording sheet, that extends perpendicularly to the transport direction, within an overall variation of ±20% or less and a local variation of ±5%/cm or less.

19. An ink jet printer of claim 18, wherein the flow air adjusting means includes a current rectifying means for rectifying air current in the gap between the ink ejection means and the recording sheet.

20. An ink jet printer of claim 16, further comprising another exhaust means provided between the belt-type preheating means and the ink ejection means for exhausting air so as to suck water vapor released from the recording sheet heated by the belt-type preheating means.

21. An ink jet printer of claim 1, wherein the ink ejection means includes a print head for printing a full-color image on the recording sheet, the print head including several nozzle rows arranged in a direction parallel to the transport direction, each nozzle row being constructed from a plurality of nozzles, aligned in a row extending perpendicularly to the transport direction, for ejecting ink droplets of a corresponding colors, a lead nozzle row positioned most upstream in the transport direction being for ejecting black ink droplets.

22. An ink jet printer of claim 21, wherein the ink ejection means further includes drive means for driving the print head to perform a dummy ejection operation to fire all of the nozzles at a predetermined cycle of printing operation to print an ink image on the recording sheet.

23. An ink jet printer of claim 22, wherein the print head is a line head provided at a fixed position so that its several nozzle rows extending in a length corresponding to the width of the recording sheet, the drive means driving the line head to perform a dummy ejection operation to fire all of the nozzles, at least once every time when one recording sheet is printed, so as to print an ink image at the bottom of each recording sheet.

24. An ink jet printer of claim 22, wherein the print head is a scanning type print head provided movable in a direction perpendicular to the transport direction, the drive means driving the scanning type print head to perform a dummy ejection operation to fire all of the nozzles, once when several recording sheets are being printed, so as to print an ink image at the bottom of a recording sheet.

25. An ink jet printer of claim 24, wherein the scanning type print head is of a reciprocal scanning type head for printing ink images at reciprocal scanning operations, a tail nozzle row positioned most downstream in the transport direction being for ejecting black ink droplets.

26. An ink jet printer of claim 1, wherein the ink ejection means includes a print head for printing an ink image on the recording sheet, the print head including:

a monolithic silicon substrate having a top surface;

a plurality of chamber walls for defining a plurality of ink chambers on the top surface of the silicon substrate, the plurality of ink chambers being aligned in a direction perpendicular to the transport direction into a row extending along the top surface of the silicon substrate, each of the plurality of ink chambers being filled with ink, each chamber wall having a nozzle portion for defining a nozzle of a plurality of nozzles, each nozzle portion being formed so that each nozzle is in fluid communication with a respective ink chamber, the plurality of nozzles being aligned in the first direction into a row extending parallel to the top surface of the silicon substrate;

an integrated circuit provided on the top surface of the silicon substrate and located adjacent to the plurality of ink chambers for outputting pulsed electric current; and a plurality of thermal resistors provided on the top surface of the silicon substrate each being located in a corresponding ink chamber of the plurality of ink chambers, each of the plurality of thermal resistors including a thin-film conductor connected to the integrated circuit for receiving the pulsed electric current from the integrated circuit and a thin-film resistor connected to the thin-film conductor for receiving the pulsed electric current from the thin-film conductor and for generating pulsed heat in response to the pulsed electric current, the thin-film resistor having a surface portion exposed to the ink contained in the corresponding ink chamber for directly heating the ink with the generated pulsed heat so as to eject an ink droplet from the corresponding ink chamber through the nozzle, the thin-film resistor being made of a material selected from a group consisting of Ta—Si—SiO alloy and Cr—Si—SiO alloy, the thin-film conductor being made of a material selected from a group consisting of tungsten and nickel.

27. An ink jet printer of claim 1, wherein the belt-type preheating means pressingly heats the recording sheet while contacting a first surface of the recording sheet and transporting the recording sheet in the transport direction, the suction transport means transporting the recording sheet while fixing a second surface of the recording sheet opposite to the first surface, onto the transport belt by the vacuum suction, the ink ejection means facing the first surface of the recording sheet, which is being transported by the suction transport means and ejecting water-based ink onto the first surface of the recording sheet.

28. An ink jet printer of claim 27, wherein the belt type preheating means includes:

a preheater for heating the recording sheet, the preheater having a heat source for generating heat, a belt mounted on the heat source in contact therewith, and a drive source for driving the belt, the belt transporting the recording sheet on one surface of the belt while contacting the heat source at the other surface, the one surface of the belt directly contacting the first surface of the sheet; and a pressure roller positioned in contact with the belt for rotating synchronously with the belt driven by the drive source, the recording sheet being transported between the belt and the pressure roller while being pressed against the pressure roller, the belt transmitting heat from the heat source to the recording sheet.

29. A method of recording on a recording medium using an ink jet print head, the method comprising the steps of:

preheating the recording medium directly before the recording medium is recorded;

transporting the recording medium, after preheating, by a transport belt while fixing the recording medium to the transport belt by vacuum suction; and controlling an ink jet print head to jet ink droplets onto the recording medium while the recording medium is being transported by the transport belt.

30. A method of claim 29, wherein the preheating step includes the step of controlling a belt to transport the recording medium thereon while transmitting heat generated from PTC heater chips to the recording medium through the belt.

31. A method of claim 30, further comprising the step of exhausting air from a region on the printed surface of the recording medium directly after recording on the recording medium with the print head.

32. A method of claim 30, further comprising the step of exhausting air from both sides of the recording medium after preheating the recording medium but before recording on the recording medium with the print head.

* * * * *